US011927403B2

(12) United States Patent
Ozono et al.

(10) Patent No.: US 11,927,403 B2
(45) Date of Patent: Mar. 12, 2024

(54) FLUID FLOW PATH DEVICE

(71) Applicant: Kobelco Eco-Solutions Co., Ltd., Hyogo (JP)

(72) Inventors: Tomohiro Ozono, Takasago (JP); Koji Noishiki, Takasago (JP); Nobumasa Ichihashi, Takasago (JP)

(73) Assignee: Kobelco Eco-Solutions Co., Ltd., Hyogo (JP)

( * ) Notice: Subject to any disclaimer, the term of this patent is extended or adjusted under 35 U.S.C. 154(b) by 409 days.

(21) Appl. No.: 17/601,902

(22) PCT Filed: May 8, 2020

(86) PCT No.: PCT/JP2020/018643
§ 371 (c)(1),
(2) Date: Oct. 6, 2021

(87) PCT Pub. No.: WO2020/230712
PCT Pub. Date: Nov. 19, 2020

(65) Prior Publication Data

US 2022/0178620 A1 Jun. 9, 2022

(30) Foreign Application Priority Data

May 10, 2019 (JP) ..... 2019-089774

(51) Int. Cl.
*F28D 9/00* (2006.01)
*F28D 7/00* (2006.01)
(Continued)

(52) U.S. Cl.
CPC ..... *F28D 9/0081* (2013.01); *F28D 7/0025* (2013.01); *F28F 7/02* (2013.01);
(Continued)

(58) Field of Classification Search
CPC ..... F28D 9/0081; F28D 7/0025; F28D 2021/0022; F28F 7/02; F28F 9/02; F28F 21/04; F28F 2275/20
See application file for complete search history.

(56) References Cited

U.S. PATENT DOCUMENTS 4,262,740 A * 4/1981 Brune ..... F28F 21/04 165/69
4,585,539 A * 4/1986 Edson ..... C25C 7/06 204/229.4
11,725,881 B2 * 8/2023 Felton ..... C04B 35/111 165/164
2004/0213083 A1 10/2004 Fujiwara et al.
(Continued)

FOREIGN PATENT DOCUMENTS

CS 249517 B2 * 9/1988
EP 1473077 A2 11/2004
(Continued)

OTHER PUBLICATIONS

The extended European search report issued by the European Patent Office dated Mar. 7, 2022, which corresponds to European Patent Application No. 20805897.4-1002 and is related to U.S. Appl. No. 17/601,902.

*Primary Examiner* — Ljiljana V. Ciric
(74) *Attorney, Agent, or Firm* — Studebaker & Brackett PC

(57) ABSTRACT

A fluid flow channel device includes a main body and a non-ceramic sub-body. The main body has a plurality of internal flow channels, and inlets and outlets thereof are arranged so as to be exposed on an outer side surface. The sub-body has a fluid supply path and a fluid recovery path. A supply port of the fluid supply path is arranged to face the inlets of the plurality of internal flow channels. A recovery port of the fluid recovery path is arranged to face the outlets of the plurality of internal flow channels. By disposing the supply port and the recovery port for transferring the fluid to and from the plurality of internal flow channels in the
(Continued)

sub-body, it is possible to prevent a large thermal stress from being applied to the main body.

7 Claims, 15 Drawing Sheets

(51) Int. Cl.

| | |
|---|---|
| ***F28D 21/00*** | (2006.01) |
| ***F28F 7/02*** | (2006.01) |
| ***F28F 9/02*** | (2006.01) |
| ***F28F 21/04*** | (2006.01) |

(52) U.S. Cl.
CPC ..... *F28F 9/02* (2013.01); *F28F 21/04* (2013.01); *F28D 2021/0022* (2013.01); *F28F 2275/20* (2013.01)

(56) References Cited

U.S. PATENT DOCUMENTS

| | | | | |
|---|---|---|---|---|
| 2010/0270011 | A1 | 10/2010 | Takahashi et al. | |
| 2014/0166137 | A1 | 6/2014 | Noishiki et al. | |
| 2017/0219148 | A1 | 8/2017 | Ozono et al. | |
| 2022/0041035 | A1* | 2/2022 | Felton | F28F 9/02 |
| 2022/0082336 | A1* | 3/2022 | Bianchi | F28D 20/0056 |
| 2022/0178620 | A1* | 6/2022 | Ozono | F28F 21/04 |
| 2023/0332845 | A1* | 10/2023 | Felton | F28D 7/0008 |

FOREIGN PATENT DOCUMENTS

| | | | | | |
|---|---|---|---|---|---|
| EP | 2246539 | A2 | | 11/2010 | |
| FR | 2545917 | A1 | * | 5/1984 | |
| JP | 2015140972 | A | * | 8/2015 | C04B 38/00 |
| WO | 2013/035253 | A1 | | 3/2013 | |
| WO | WO-2018067026 | A1 | * | 4/2018 | |
| WO | WO-2022175411 | A1 | * | 8/2022 | F28D 7/10 |

* cited by examiner

FLUID FLOW PATH DEVICE

TECHNICAL FIELD

The present invention relates to a fluid flow channel device.

BACKGROUND ART

Conventionally, a stacked-type fluid flow channel device that is formed by stacking layers in which a plurality of channels is arranged to allow fluid to flow therethrough is known. The fluid flow channel device is used to generate chemical reactions and other interactions between fluids while allowing fluid to flow through each channel. Patent Literature 1 discloses such a fluid flow channel device (flow channel structure).

The flow channel structure disclosed in Patent Literature 1 is provided with a plurality of ceramic flow channel layers each having a plurality of flow channels formed therein and laminated to each other, two outermost flow channel layers disposed on both sides of the plurality of flow channel layers in a lamination direction of the plurality of flow channel layers, outer elastic sheets that are interposed between each outermost layer and the flow channel layer adjacent to the outermost layer and is made of an elastic body, and fastening members that fastens the two outermost layers to each other in a state where the two outermost layers sandwich the plurality of flow channel layers from both sides in the lamination direction.

In such a flow channel structure, since each flow channel is defined by the ceramic, it is possible to prevent the fluid flow channel device from corroding due to the influence of the fluid. Since the outer elastic sheets are interposed between each outermost layer and the channel layer adjacent to the outermost layer, even if bending deformation occurs in each outermost layer by fastening of the fastening member, the bending deformation of the outermost layer can be absorbed by the outer elastic sheet to prevent the bending deformation from being transmitted to the flow channel layer. As a result, damage to the channel layer is prevented.

CITATION LIST

Patent Literature

Patent Literature 1: Japanese Unexamined Patent Publication No. 2017-136535

In the technique described in Patent Literature 1, a fluid supply unit (header) for supplying a fluid to each flow channel is mounted on an upper surface of one outermost layer. On the other hand, an opening (through-hole) for receiving the fluid from the fluid supply unit is formed in each of the flow channel layers made of ceramics. The fluid entering each opening along the stacking direction from the fluid supply unit enters the flow channel through the inlet of each flow channel communicating with the opening. When a high temperature or low temperature fluid is supplied into the fluid flow channel device having such a structure, the periphery of the opening in the flow channel layer is close to the temperature of the fluid, while the temperature of the outer peripheral edge of the flow channel layer is close to the surrounding environmental temperature (normal temperature). Due to such a temperature difference, a large thermal stress is applied to a portion connecting the outer peripheral edge of the channel layer and the opening, and a part of the ceramic channel layer tends to be broken.

SUMMARY OF INVENTION

The present invention has been made in view of the above-mentioned problems, and it is an object of the present invention to provide a fluid flow channel device including a ceramic body having a plurality of internal flow channels, wherein a portion of the body is prevented from being damaged due to the influence of the temperature of the fluid.

A fluid flow channel device according to one aspect of the present invention is provided with a ceramic main body and a non-ceramic sub-body. The main body includes a plurality of internal flow channels each including an inlet and an outlet independent of each other and allowing fluid to flow along at least one flow channel surface, and at least one outer surface orthogonal to the at least one flow channel surface, wherein the inlets of the plurality of internal flow channels are disposed so as to be adjacent to each other and exposed to the at least one outer surface, the outlets of the plurality of internal flow channels are disposed so as to be adjacent to each other and exposed to the at least one outer surface. The sub-body includes at least one inner surface and at least one fluid supply passage allowing fluid to flow therethrough and having a supply port exposed to the at least one inner surface and supplying fluid to the plurality of internal flow channels in a lump, and at least one fluid recovery passage allowing fluid to flow therethrough and including a recovery port exposed to the at least one inner surface and receiving fluid from the plurality of internal flow passages in a lump wherein the at least one inner surface is disposed in close contact with the at least one outer surface of the main body such that the supply port is disposed opposite the plurality of inlets so as to cover the inlets of the plurality of internal flow channels and the recovery port is disposed opposite the plurality of outlets so as to cover the outlets of the plurality of internal flow channels.

DESCRIPTION OF EMBODIMENTS

Figure 1:
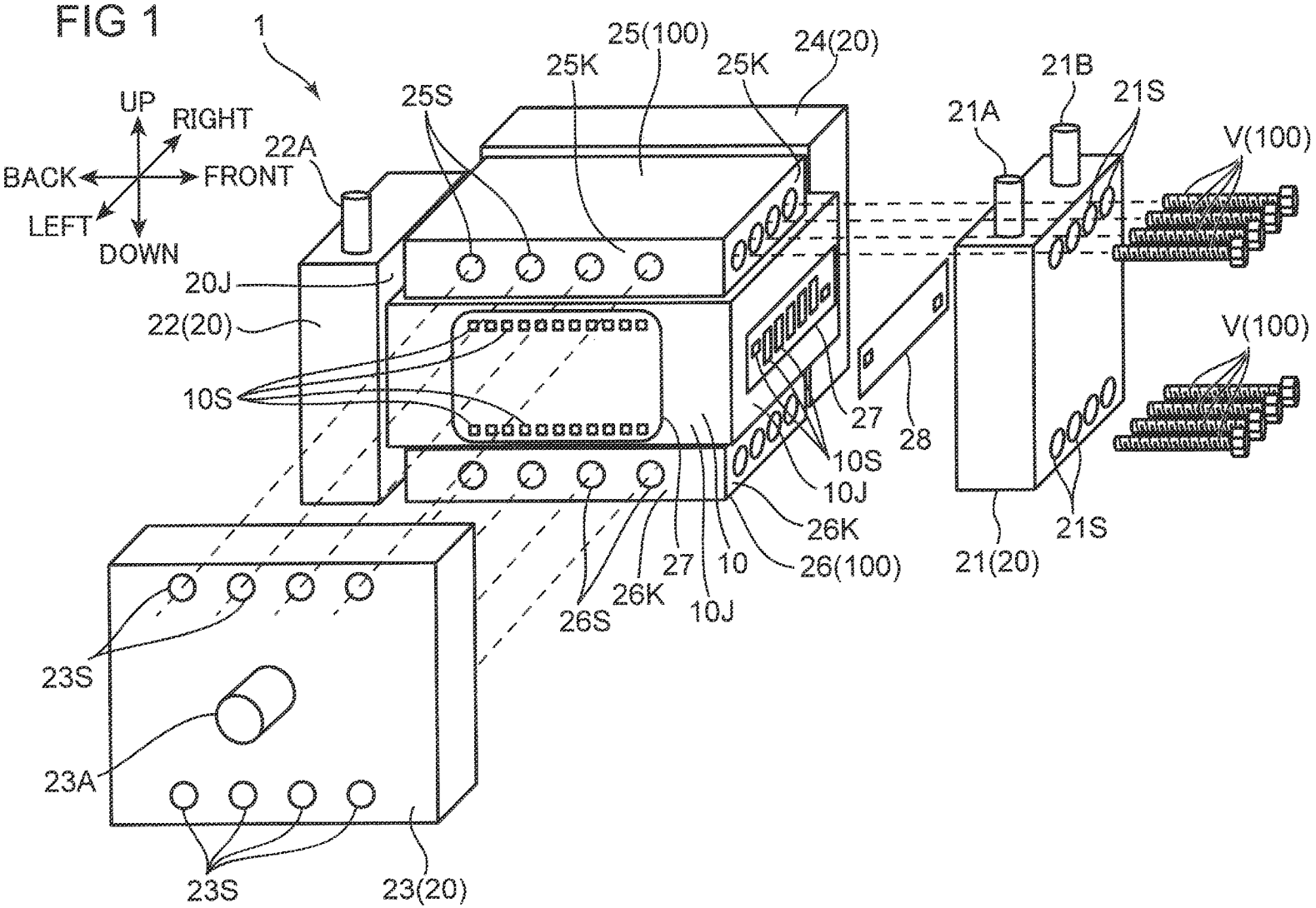
FIG. 1 is an exploded perspective view of a fluid flow channel device according to an embodiment of the present invention.
Figure 2:
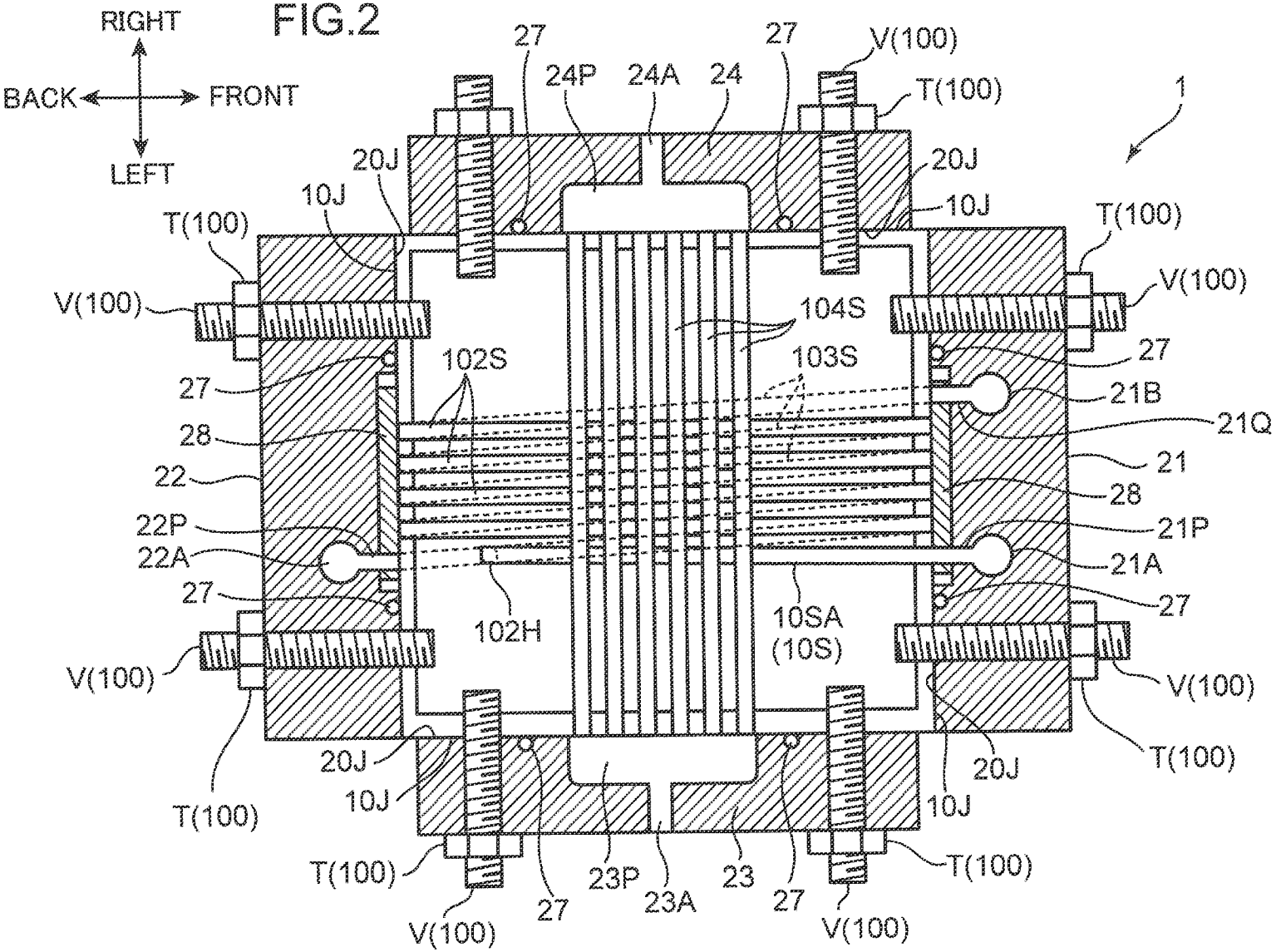
FIG. 2 is a horizontal cross-sectional view of the fluid flow channel device according to an embodiment of the present invention.
Figure 3:
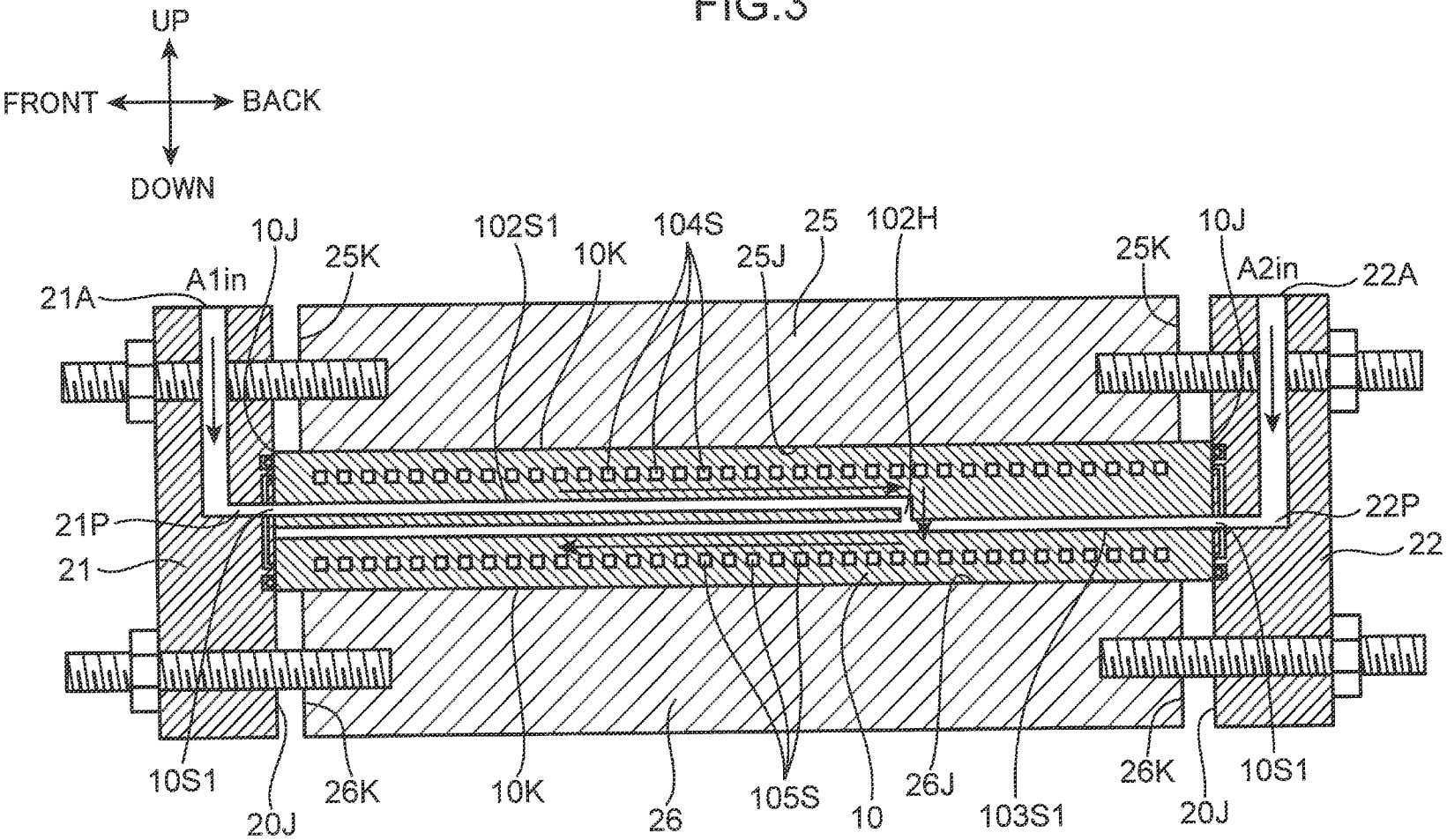
FIG. 3 is a schematic side cross-sectional view for explaining a flow of fluid in the fluid flow channel device according to an embodiment of the present invention.
Figure 4:
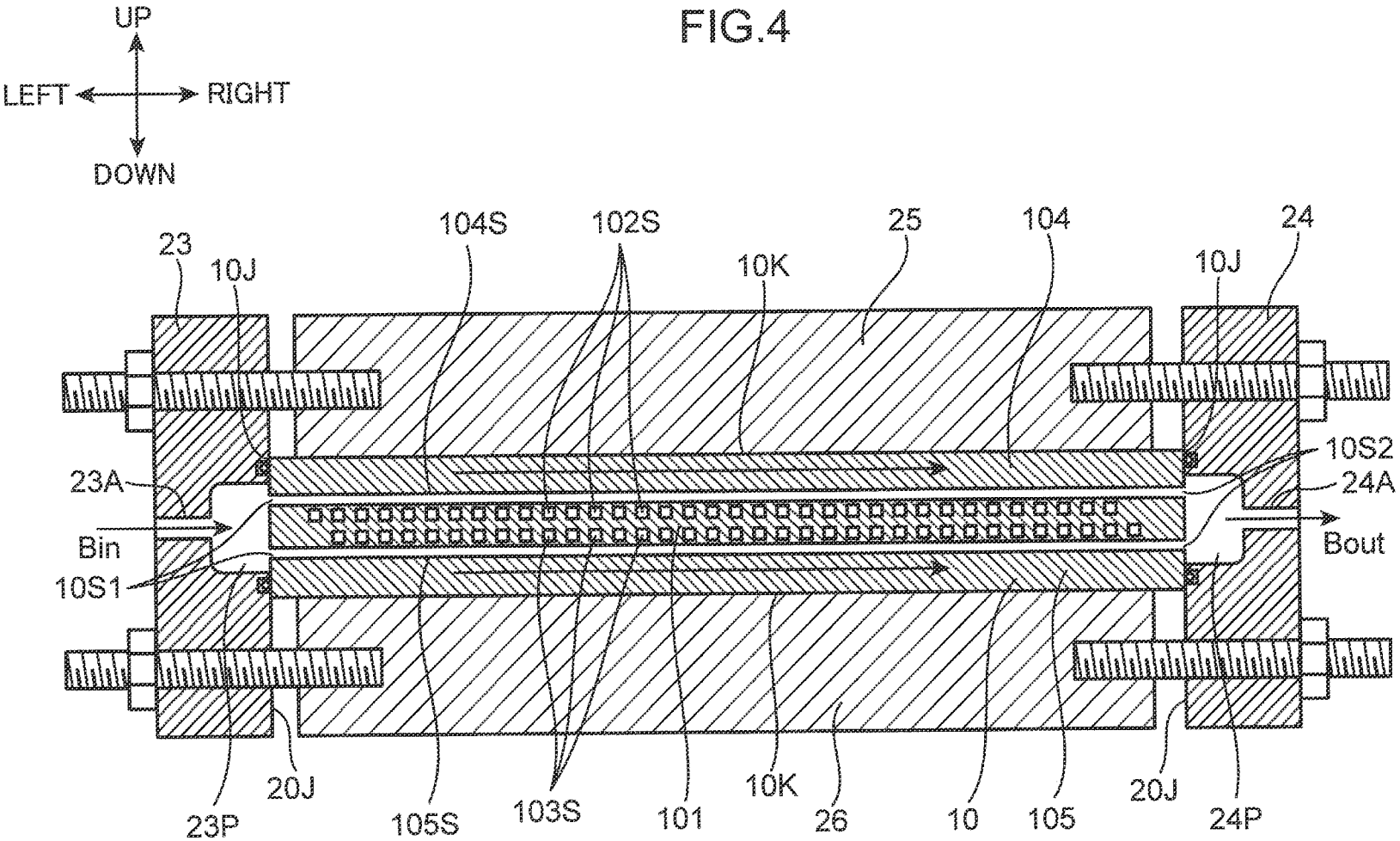
FIG. 4 is a schematic side cross-sectional view for explaining a flow of fluid in the fluid flow channel device according to an embodiment of the present invention.
Figure 5:
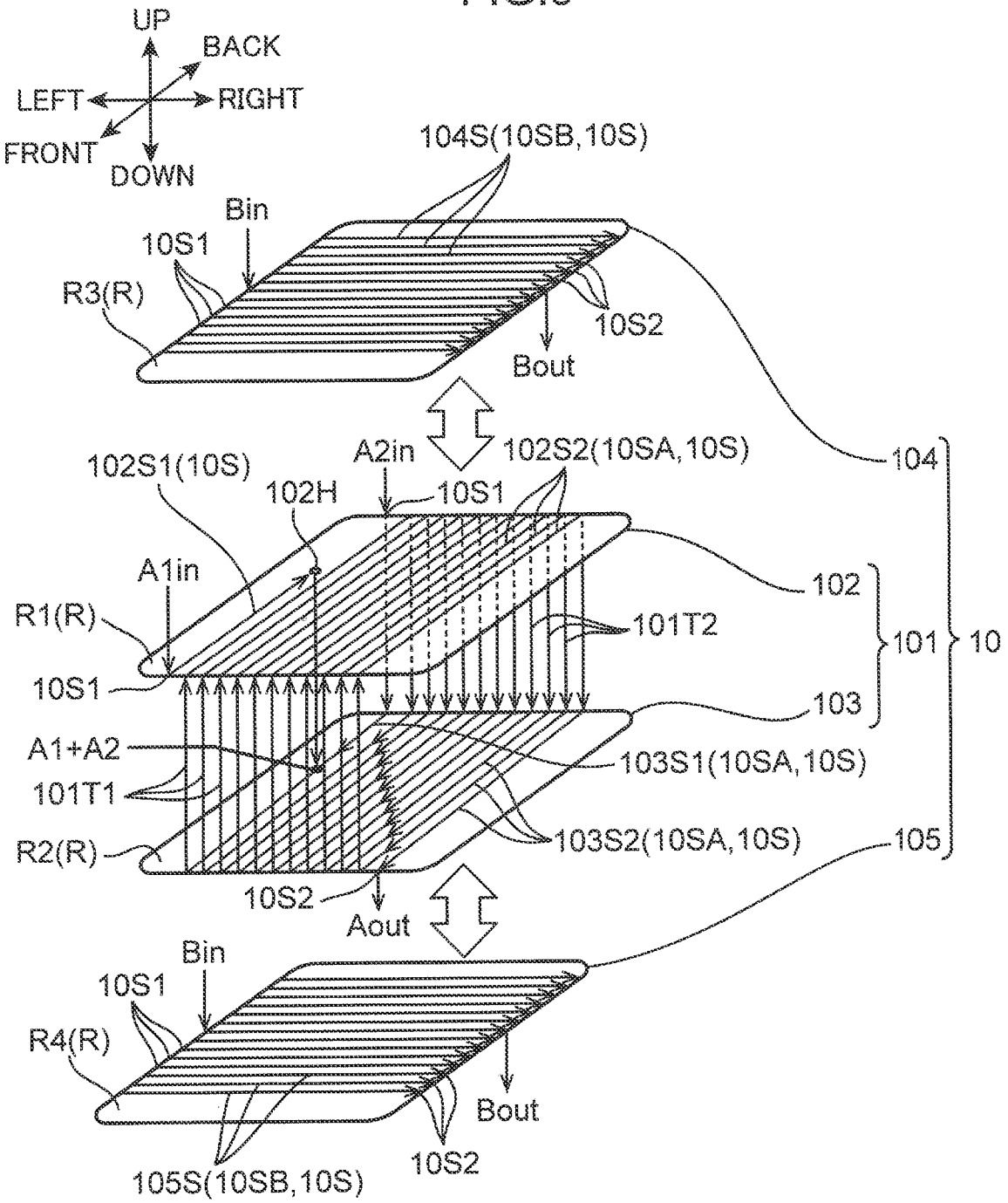
FIG. 5 is a schematic exploded perspective view of a main body of the fluid flow channel device according to an embodiment of the present invention.
Figure 6:
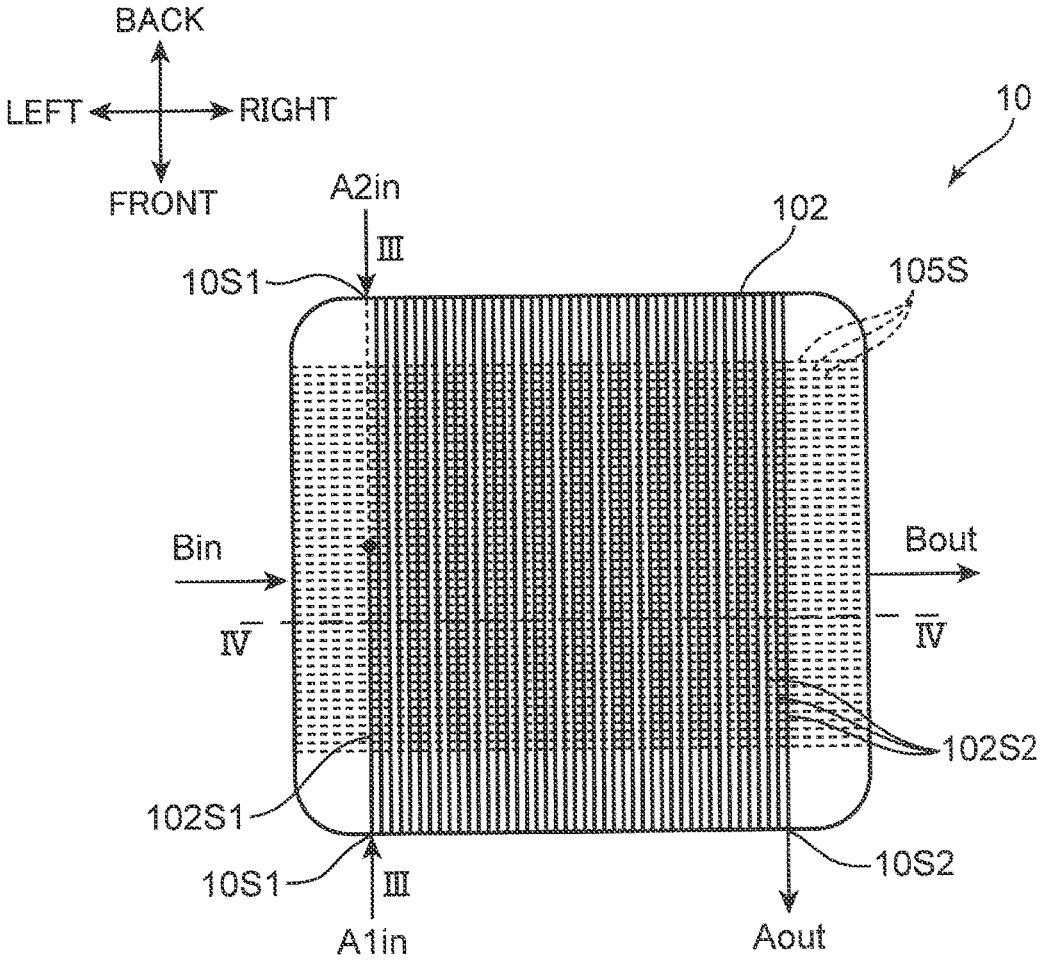
FIG. 6 is a plan view of the main body of the fluid flow channel device according to an embodiment of the present invention.
Figure 7:
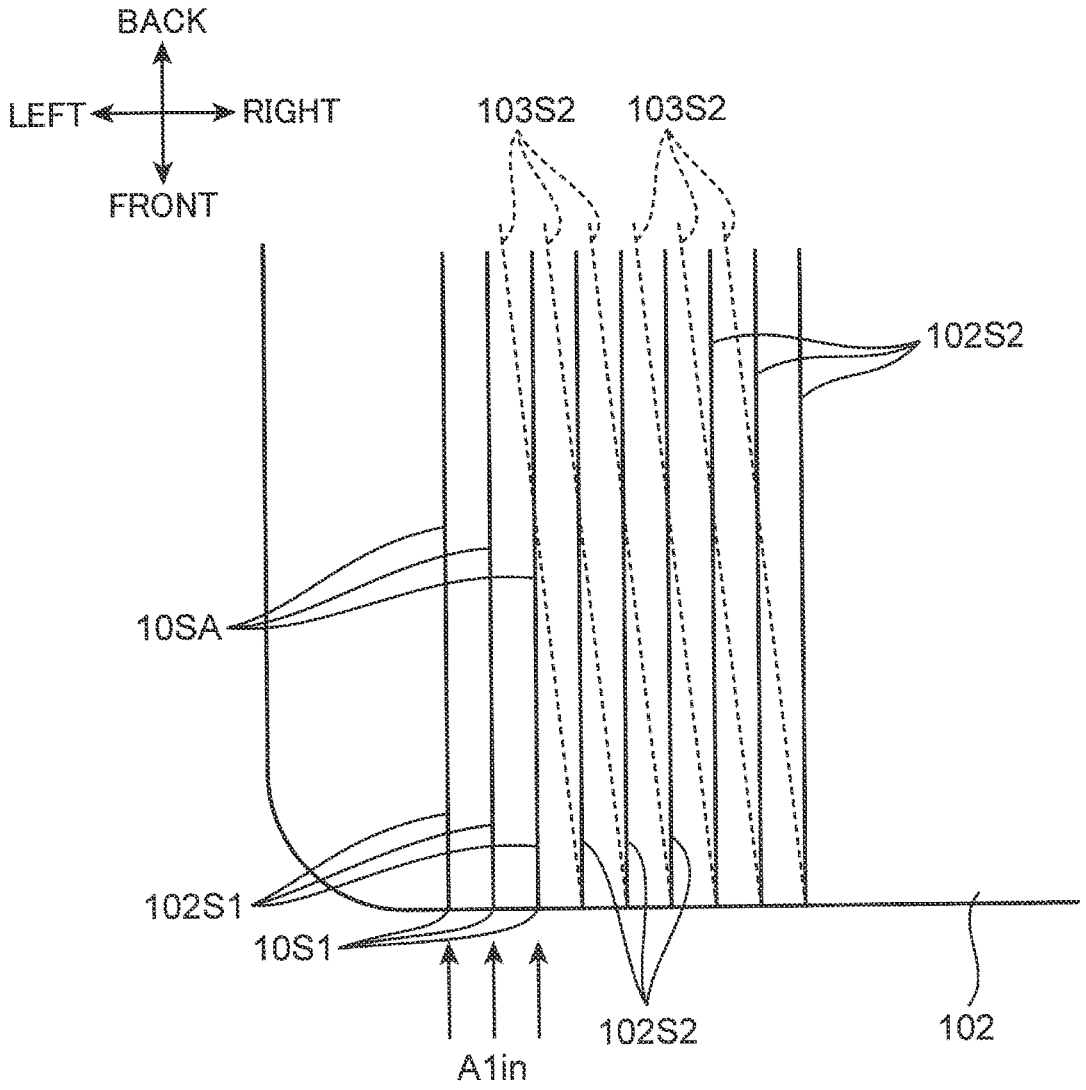
FIG. 7 is an enlarged plan view of a portion of FIG. 6 enlarged.

A fluid flow channel device 1 according to an embodiment of the present invention will be described below with reference to the drawings. FIG. 1 is an exploded perspective view of the fluid flow channel device 1 according to the present embodiment. FIG. 2 is a horizontal cross-sectional view of the fluid flow channel device 1 according to the present embodiment. FIGS. 3 and 4 are schematic side sectional views for explaining the flow of fluid in the fluid flow channel device 1 according to the present embodiment. FIG. 5 is a schematic exploded perspective view of a ceramic core 10 of the fluid flow channel device 1 according to the present embodiment. FIG. 6 is a plan view of the ceramic core 10 of the fluid flow channel device 1 according to the present embodiment. FIG. 7 is an enlarged plan view of a part of FIG. 6 enlarged. FIG. 3 corresponds to the cross-section of FIG. 6, and FIG. 4 corresponds to the cross-section IV-IV of FIG. 6. The fluid flow channel device 1 is provided with a plurality of internal flow channels 10S that allow fluid to flow, and causes the fluid to interact with each other in the process in which the fluid flows, such as mixing, absorption, separation, heat exchange, or chemical reaction. In FIGS. 5 to 7, a straight line and a broken line are shown for one flow channel.

The fluid flow channel device 1 includes a ceramic core 10 (main body), a core holding portion 20 (sub-body), and a connecting portion 100.

The ceramic core 10 has a rectangular parallelepiped shape, and is composed of ceramics such as alumina and SiC (silicon carbide). In other words, the ceramic core 10 is made of a brittle material. The ceramic core 10 is formed by firing (sintering) the superposed flow channel layers in a state where the plurality of flow channel layers is overlapped with each other as described later. The ceramic core 10 also includes a plurality of internal flow channels 10S each including an inlet and an outlet independent of each other and allowing fluid to flow along at least one flow channel surface R (FIG. 5), and at least one outer surface 10J orthogonal to the at least one flow channel surface R. In this embodiment, the ceramic core 10 has four flow channel surfaces R (a first flow channel surface R1, a second flow channel surface R2, a third flow channel surface R3, and a fourth flow channel surface R4) (FIG. 5) as at least one flow channel surface R. Each flow channel surface R extends in a horizontal direction and is arranged in parallel with each other. The ceramic core 10 has four outer surfaces 10J as at least one outer surface 10J (FIG. 2). Each outer surface 10J constitutes a rectangular parallelepiped side surface of the ceramic core 10.

Further, the ceramic core 10 has a pair of upper and lower sub outer surfaces 10K (FIGS. 3 and 4). The pair of sub outer surfaces 10K corresponds to the top and bottom surfaces of the rectangular parallelepiped shape of the ceramic core 10. That is, the pair of sub outer surfaces 10K connects one end (upper end) of the four outer surfaces 10J in the vertical direction (a specific direction orthogonal to the at least one flow channel surface R) to each other and connects the other end (lower end) of the four outer surfaces 10J in the vertical direction to each other.

The inlets 10S1 (FIGS. 3 and 4) of the plurality of internal flow channels 10S disposed in the ceramic core 10 are disposed so as to be adjacent to each other and exposed to the outer surface 10J of the ceramic core 10, and the outlets 10S2 (FIG. 4) of the plurality of internal flow channels 10S are disposed so as to be adjacent to each other and exposed to the outer surface 10J.

The core holding portion 20 holds the ceramic core 10, supplies fluid to a plurality of internal flow channels 10S in the ceramic core 10, and recovers the fluid from the plurality of internal flow channels 10S. The core holding portion 20 has a front holding portion 21 (a first sub-body member), a rear holding portion 22 (a second sub-body member), a left holding portion 23 (a third sub-body member), a right holding portion 24 (a fourth sub-body member) (they are at least four sub-body members). Each of the holding portions has a substantially rectangular parallelepiped shape having an inner surface 20J (FIGS. 3 and 4) facing the ceramic core 10. Each of the holding portions is composed of a metal such as SUS, Hastelloy™, or a resin such as PEEK (polyether ether ketone). In other words, the core holding portion 20 is made of a non-ceramic (ductile material). The brittleness of the core holding portion 20 is relatively lower than that of the ceramic core 10.

As shown in FIG. 1, the front holding portion 21, the rear holding portion 22, the left holding portion 23, and the right holding portion 24 are arranged so as to sandwich the ceramic core 10 from four sides along a horizontal surface (a surface parallel to the flow channel surface R).

The inner surface 20J (FIG. 2, FIG. 3) (first outer surface) of the front holding portion 21 is arranged so as to be in close contact with the outer surface 10J on the front side of the ceramic core 10. The front holding portion 21 has a fluid supply path 21A and a fluid recovery path 21B (FIGS. 1, 2, 3). The fluid supply path 21A is a flow path through which the fluid supplied to the ceramic core 10 flows. The fluid supply path 21A has a supply port 21P (FIG. 2, FIG. 3) that is exposed to the inner surface 20J of the front holding portion 21 and supplies fluid to the plurality of internal flow channels 10S collectively. The fluid flowing through the fluid supply path 21A is defined as fluid A1 (FIG. 3). The fluid recovery path 21B (FIG. 1, FIG. 2) is a flow path through which the fluid discharged from the ceramic core 10 flows. The fluid recovery path 21B has a recovery port 21Q (FIG. 2) that is exposed to the inner surface 20J of the front holding portion 21 and receives the fluid collectively from the plurality of internal flow channels 10S. When the ceramic core 10 and the front holding portion 21 are arranged in close contact with each other by the connecting portion 100, the supply port 21P is disposed facing the plurality of inlets 10S1 of the plurality of internal flow channels 10S so as to cover the inlets 10S1 (FIGS. 3 and 7) formed on the outer surface 10J on the front side of the ceramic core 10, and the recovery port is disposed facing the plurality of outlets 10S2 of the plurality of internal flow channels 10S so as to cover the outlets 10S2.

The inner surface 20J (FIGS. 2, 3) (second outer surface) of the rear holding portion 22 is arranged so as to be in close contact with the outer surface 10J on the rear side of the ceramic core 10. The rear holding portion 22 has a fluid supply path 22A (FIGS. 1, 2, and 3). The fluid supply path 22A is a flow path through which the fluid supplied to the ceramic core 10 flows. The fluid supply path 22A has a supply port 22P (FIGS. 2, 3) that is exposed to the inner surface 20J of the rear holding portion 22 and supplies fluid to the plurality of internal flow channels 10S collectively. The fluid flowing through the fluid supply path 22A is defined as fluid A2 (FIG. 3). When the ceramic core 10 and the rear holding portion 22 are arranged in close contact with each other by the connecting portion 100, the supply port 22P is disposed facing the plurality of inlets 10S1 of the plurality of internal flow channels 10S formed on the outer surface 10J on the rear side of the ceramic core 10 so as to cover the inlets 10S1 (FIG. 3).

The inner surface 20J (FIGS. 2, 4) (third outer surface) of the left holding portion 23 is arranged so as to be in close contact with the outer surface 10J on the left side of the ceramic core 10. The left holding portion 23 has a fluid supply path 23A (FIGS. 2 and 4). The fluid supply path 23A is a flow path through which the fluid supplied to the first temperature adjustment layer 104 and the second temperature adjustment layer 105 (FIG. 5) of the ceramic core 10 flows. The fluid supply path 23A has a supply port 23P (FIGS. 2 and 4) that is exposed to the inner surface 20J of the left holding portion 23 and supply fluid to the plurality of internal flow channels 10S (flow paths 104S, 105S) collectively. The fluid flowing through the fluid supply path 23A is defined as a fluid B (FIG. 4). When the ceramic core 10 and the left holding portion 23 are arranged in close contact with each other by the connecting portion 100, the supply port 23P is disposed facing the plurality of inlets 10S1 of the plurality of internal flow channels 10S formed on the outer surface 10J on the left side of the ceramic core 10 so as to cover the inlet 10S1.

The inner surface 20J (FIGS. 2, 4) (forth outer surface) of the right holding portion 24 is arranged so as to be in close contact with the outer surface 10J on the right side of the ceramic core 10. The right holding portion 24 has a fluid recovery path 24A (FIGS. 2, 4). The fluid recovery path 24A is a flow path through which the fluid recovered from the first temperature adjustment layer 104 and the second temperature adjustment layer 105 (FIG. 5) of the ceramic core 10 flows. The fluid recovery path 24A has a recovery port 24P (FIGS. 2 and 4) that is exposed to the inner surface 20J of the right holding portion 24 and receive the fluid B from the plurality of internal flow channels 10S (flow paths 104S, 105S) collectively. When the ceramic core 10 and the right holding portion 24 are arranged in close contact with each other by the connecting portion 100, the recovery port 24P is disposed facing the plurality of outlets 10S2 of the plurality of internal flow channels 10S formed in the outer surface 10J on the right side of the ceramic core 10 so as to cover the outlets 10S2.

The cross-sectional area (opening area) of the supply port and the recovery port formed in each holding portion is larger than the total of the opening area of the inlets 10S1 of the plurality of opposed internal flow channels 10S or the total of the opening area of the outlets 10S2 of the plurality of internal flow channels 10S.

As shown in FIG. 1, the front holding portion 21, the rear holding portion 22, the left holding portion 23 and the right holding portion 24 each have a dimension larger than that of the ceramic core 10 in the vertical direction so as to protrude from one end side (upper end side) and the other end side (lower end side) of the ceramic core 10 in the vertical direction (specific direction).

A plurality of bolt holes for receiving the bolts V described later are formed at the upper ends and the lower ends of the front holding portion 21, the rear holding portion 22, the left holding portion 23 and the right holding portion 24, respectively. In FIG. 1, only the bolt holes 21S of the front holding portion 21 and the bolt holes 23S of the left holding portion 23 appear, but similar bolt holes are also formed in the rear holding portion 22 and the right holding portion 24.

The connecting portion 100 (FIG. 1) connects the front holding portion 21, the rear holding portion 22, the left holding portion 23 and 34 to each other along a direction parallel to the flow channel surface R so that the four front holding portions 21, the rear holding portion 22, the left holding portion 23 and the right holding portion 24 hold the ceramic core 10. The connecting portion 100 includes an upper connecting plate 25 and a lower connecting plate 26 (a pair of connecting body members), a plurality of bolts V (connecting members) and a plurality of nuts T (connecting members).

The upper connecting plate 25 and the lower connecting plate 26 (FIGS. 1 and 3) have a rectangular parallelepiped shape and are composed of the same material as the core holding portion 20. The upper connecting plate 25 and the lower connecting plate 26 need not necessarily be the same material as the core holding portion 20 if they are composed of a ductile material (non-ceramic) such as a metallic material or a resin material. The upper connecting plate 25 has a first opposing surface 25J (FIG. 3) and four second opposing surfaces 25K (FIGS. 1 and 3), and the lower connecting plate 26 has a first opposing surface 26J (FIG. 3) and four second opposing surfaces 26K (FIGS. 1 and 3). Four or more second opposing surfaces may be arranged on the upper connecting plate 25 and the lower connecting plate 26. The first opposing surface 25J of the upper connecting plate 25 corresponds to the lower surface of the upper connecting plate 25 and is disposed facing the sub outer surface 10K on the upper side of the ceramic core 10 (FIG. 3). Similarly, the first opposing surface 26J of the lower connecting plate 26 corresponds to the upper surface of the lower connecting plate 26 and is disposed facing the sub outer surface 10K on the lower side of the ceramic core 10 (FIG. 3). The four second opposing surfaces 25K of the upper connecting plate 25 and the four second opposing surfaces 26K of the lower connecting plate 26 are disposed opposite to the front holding portion 21, the rear holding portion 22, the left holding portion 23 and the right holding portion 24 respectively. A plurality of bolt holes 25S and a plurality of bolt holes 26S are formed on the upper connecting plate 25 and the lower connecting plate 26 so as to face each bolt hole formed in the front holding portion 21, the rear holding portion 22, the left holding portion 23 and the right holding portion 24 (FIG. 1).

The plurality of bolts V are inserted into each bolt hole (21S, 23S) of the front holding portion 21, the rear holding portion 22, the left holding portion 23 and the right holding portion 24, and fastened to the bolt holes 25S, 26S formed in the upper connecting plate 25 or the lower connecting plate 26. The nut T is fastened to the bolt V so that each inner surface 20J of the front holding portion 21, the rear holding portion 22, the left holding portion 23 and the right holding portion 24 is in close contact with the outer surface 10J of the ceramic core 10. As shown in FIG. 1, O-rings 27 are arranged between each holding portion and the ceramic core 10 so as to surround the inlet or the outlet of the internal flow channel 10S, and gaskets 28 partially formed with openings are arranged for allowing the fluid to flow in or out of a part of the plurality of internal flow channels 10S. In other words, with respect to the plurality of bolts V and the plurality of nuts T, these members connect one ends and other ends of the front holding portion 21, the rear holding portion 22, the left holding portion 23 and the right holding portion 24 with the upper connecting plate 25 and the lower connecting plate 26 to each other along a horizontal direction (a direction parallel to the flow channel surface R) so that the front holding portion 21, the rear holding portion 22, the left holding portion 23, and the right holding portion 24, the upper connecting plate 25 and the lower connecting plate 26 house the ceramic core 10 therein.

Referring to FIG. 5, the ceramic core 10 includes a process layer 101, a first temperature adjustment layer 104 and a second temperature adjustment layer 105. The process layer 101 has a first process layer 102 and a second process layer 103. As described above, the ceramic core 10 is formed by being fired in a state where the four channel layers (the first process layer 102, the second process layer 103, the first temperature adjustment layer 104 and the second temperature adjustment layer 105) are overlapped with each other. Each of the flow channel layers has a flow path forming a part of the internal flow channel 10S. In FIG. 5, the thickness in the vertical direction of each channel layer is omitted.

A flow path is formed in the first process layer 102 allowing fluid to flow along the first flow channel surface R1. Specifically, the first process layer 102 has a flow path 102S1 (a first internal flow channel) and a plurality of flow paths 102S2 (a plurality of first internal flow channels). Each flow path extends linearly so as to connect the front edge of the first process layer 102 (the outer surface 10J of the front side of the ceramic core 10, one outer surface) and the rear edge of the first process layer 102 (the outer surface 10J of the rear side of the ceramic core 10, other outer surface). Each flow path is formed by a groove on the upper surface of the first process layer 102. As shown in FIG. 5, the flow path 102S1 is disposed at the left end of the first process layer 102 from the front edge of the first process layer 102 to the center of the first process layer 102. The downstream end of the flow path 102S1 merges into the flow path 103S1 described later by a confluence groove 102H penetrating through the first process layer 102 in the vertical direction.

A flow path is formed in the second process layer 103 to allow fluid to flow along the second flow channel surface R2. The second flow channel surface R2 is disposed at an interval in the vertical direction with respect to the first flow channel surface R1. The second process layer 103 has a flow path 103S1 (a second internal flow channel) and a plurality of flow paths 103S2 (a plurality of second internal flow channels). Each flow path extends linearly so as to connect the front edge of the second process layer 103 (outer surface 10J on the front side of the ceramic core 10, one outer surface) and the rear edge of the second process layer 103 (outer surface 10J on the rear side of the ceramic core 10, other outer surface) to each other. Each flow path is formed by a groove on the upper surface of the second process layer 103. As shown in FIG. 5, the flow path 103S1 is disposed at the left end of the second process layer 103 from the rear edge of the second process layer 103 to the front edge of the second process layer 103. The aforementioned confluence groove 102H is communicated with the central portion of the flow path 103S1. The plurality of paths 103S2 is disposed at predetermined intervals in the right and left direction on the right side of the flow path 103S1.

The first temperature adjustment layer 104 is disposed above the first process layer 102. The first temperature adjustment layer 104 is formed of a temperature adjustment flow path 10SB (internal flow channel 10S) for allowing fluid to flow along the third flow channel surface R3. Specifically, the first temperature adjustment layer 104 has a plurality of flow paths 104S constituting the temperature adjustment flow path 105B. The plurality of flow paths 104S extends linearly so as to connect the left edge of the first temperature adjustment layer 104 (the outer surface 10J on the left side of the ceramic core 10, one outer surface) and the right edge of the first temperature adjustment layer 104 (the outer surface 10J on the right side of the ceramic core 10, other outer surface) to each other. Each flow path 104S is formed by a groove on the upper surface of the first temperature adjustment layer 104.

Similarly, the second temperature adjustment layer 105 is disposed below the second process layer 103. The second temperature adjustment layer 105 is formed of a temperature adjustment flow path 10SB for allowing the fluid to flow along the fourth flow channel surface R4. Specifically, the second temperature adjustment layer 105 has a plurality of flow paths 105S constituting the above-mentioned temperature adjustment flow path 10SB. The plurality of flow paths 105S extends linearly so as to connect the left edge of the second temperature adjustment layer 105 (the outer surface 10J on the left side of the ceramic core 10, one outer surface) and the right edge of the second temperature adjustment layer 105 (the outer surface 10J on the right side of the ceramic core 10, other outer surface) to each other. Each flow path is formed by a groove on the upper surface of the second temperature adjustment layer 105.

The plurality of flow paths 104S of the first temperature adjustment layer 104 allows fluid B for exchanging heat with the fluid (A1, A2) flowing through the plurality of flow paths 102S2 of the first process layer 102 to flow. Similarly, the plurality of flow paths 105S of the second temperature adjustment layer 105 allows fluid B for exchanging heat with the fluid (A1, A2) flowing through the plurality of flow paths 103S2 of the second process layer 103 to flow. Referring to FIGS. 5 and 6, when the ceramic core 10 is viewed from the vertical direction (specific direction), the plurality of flow paths 104S (flow paths 105S) are disposed so as to intersect with (orthogonal to) the plurality of flow paths 102S2 (flow paths 103S2).

In this embodiment, a spiral process flow path 10SA is formed in the first process layer 102 and the second process layer 103 (see arrows in FIG. 5). The upstream end (front end) of the flow path 102S1 of the process layer 101 communicates with the aforementioned supply port 21P (FIG. 3), and constitutes an inlet 10S1 into which the fluid A1 flows. On the other hand, the upstream end of the plurality of flow paths 102S2 communicates with the downstream end (front end) of the plurality of flow paths 103S2 of the second process layer 103 via a first connection flow path 101T1 (the first connection flow path) without communicating with the supply port 21P. The first connection flow path 101T1 is formed by a groove on a side surface of the front side of the process layer 101 and the first process layer 102. An inlet 10S1 communicating with the supply port 22P and receiving the fluid A2 is formed at the left end of the rear edge of the first process layer 102.

Similarly, the downstream end (rear end) of the plurality of flow paths 102S2 of the first process layer 102 communicates with the upstream end (rear end) of the plurality of flow paths 103S2 of the second process layer 103 via a second connection flow path 101T2 (second connection flow path) without communicating with the supply port 22P. The plurality of second connection paths 101T2 is formed by grooves formed on the rear side surface of the process layer 101 and the first process layer 102. The inlet 10S1 formed at the rear edge of the first process layer 102 and receiving the fluid A2 communicates with the upstream end of the flow path 10351 through the second connection flow path 101T2.

An outlet 10S2 communicating with the recovery port 21Q of the fluid recovery path 21B (FIG. 2) is disposed at the downstream end of the flow path 103S2 located at the most right out of the plurality of flow paths 103S2 of the second process layer 103.

As described above, the plurality of flow paths 102S1, 102S2 on the first process layer 102, the plurality of flow paths 103S1, 103S2 on the second process layer 103, the plurality of first connection flow paths 101T1 and the plurality of second connection flow paths 101T2 constitute the process flow path 10SA. The process flow path 10SA is spirally connected so as to allow fluid (A1, A2) flowing through the process flow path 10SA to move in the right direction (a direction parallel to the first flow channel surface R1 and in a direction intersecting the plurality of flow paths 102S2). The inlets 10S1 of the spiral process flow path 10SA are disposed at front and back two positions, and the outlet 10S2 of the process flow path 10SA is disposed at one position.

Although one process flow path 10SA spirally formed in the first process layer 102 and the second process layer 103 has been described in FIG. 5, in practice, as shown in FIG. 7, a plurality of spiral process flow paths 10SA is arranged adjacent to each other in the first process layer 102 and the second process layer 103. Therefore, a plurality of inlets 1051 for receiving the fluid A1 in each process flow path 10SA is also disposed adjacent to each other in the left and right direction. Similarly, a plurality of inlets 1051 for receiving fluid A2 in each process flow path 10SA and a plurality of outlets 10S2 for discharging the mixed fluids A1+A2 from each process flow path 10SA is also disposed adjacent to each other in the left and right direction.

The fluid A1 flowing through the fluid supply path 21A of the front holding portion 21 flows into the inlet 10S1 on the front side of each process flow path 10SA from the supply port 21P and flows (FIG. 3) through the flow path 102S1 (FIG. 5). On the other hand, the fluid A2 flowing in the fluid supply path 22A of the rear holding portion 22 flows into the inlet 10S1 on the rear side of each process flow path 10SA from the supply port 22P, and flows into the flow path 103S1 (FIG. 3) through the second connection flow path 101T2 (FIG. 5). The fluids A1, A2 merge and mix at the lower end of the confluence groove 102H (FIG. 3). The mixed fluid A1+A2 flows through the spiral process flow path 10SA, and then is discharged from the outlet 10S2 disposed at the front edge of the second process layer 103 to the fluid recovery path 21B (FIG. 2).

On the other hand, in the first temperature adjustment layer 104 and the second temperature adjustment layer 105, fluid B for exchanging heat with the aforementioned mixed fluid A1+A2 flows through the supply port 23P of the fluid supply path 23A to the inlet 10S1 of the plurality of flow paths 104S and the plurality of flow paths 105S (FIGS. 2, 4). The fluid B flowing through the plurality of flow paths 104S and the plurality of flow paths 105S is recovered from each outlet 10S2 of the first temperature adjustment layer 104 and the second temperature adjustment layer 105 to the fluid recovery path 24A through the recovery port 24P (FIGS. 2, 4).

Figure 14:
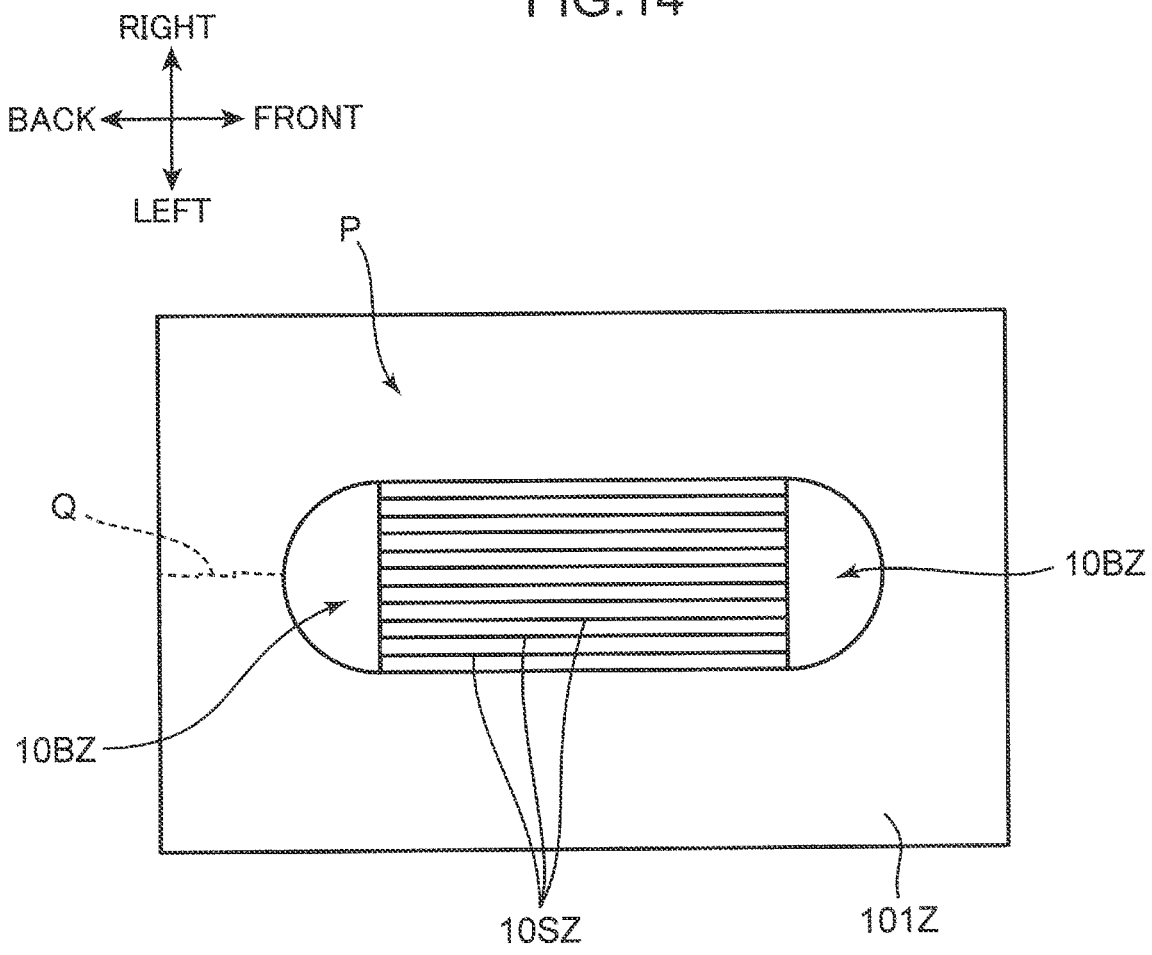
FIG. 14 is a horizontal cross-sectional view of a main body of a conventional fluid flow channel device.
Figure 15:
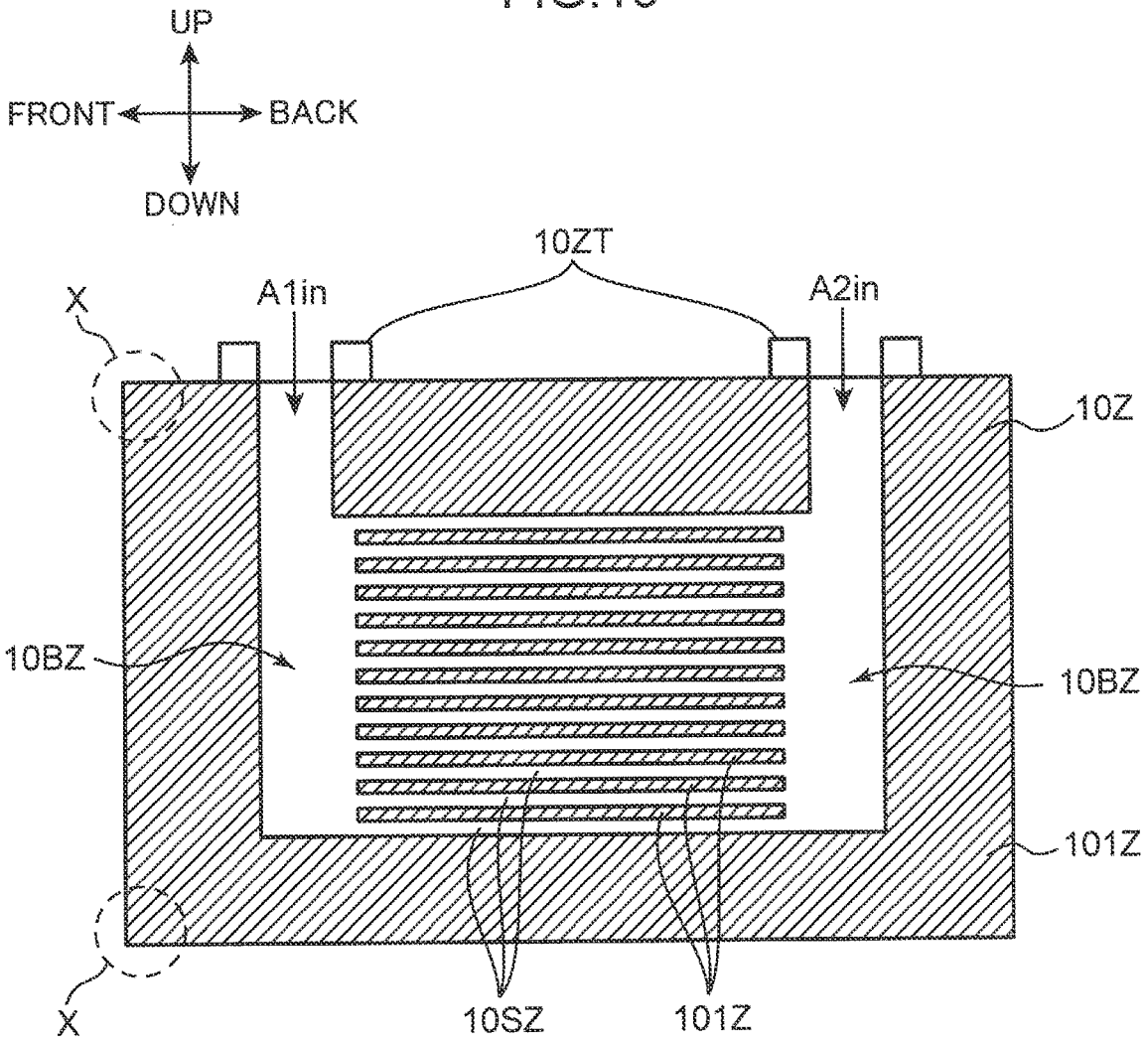
FIG. 15 is a side cross-sectional view of the main body of the conventional fluid flow channel device.

FIG. 14 is a horizontal cross-sectional view of a ceramic core 10Z of a conventional fluid flow channel device. FIG. 15 is a side cross-sectional view of the ceramic core 10Z of the conventional fluid flow channel device. The ceramic core 10Z is formed by laminating a plurality of flow channel layers 101Z. An internal flow channel 10SZ is formed in each of the flow channel layers 101Z. In the fluid flow channel device, there is no core holding portion 20 according to the present embodiment, and a fluid supply portion 10ZT for supplying fluid A1, A2 is disposed (FIG. 15) on an upper surface portion of the ceramic core 10Z. In the ceramic core 10Z, two openings 10BZ for receiving the fluids A1 and A2 supplied from the fluid supply portion 10ZT are opened. The opening 10BZ communicates with an inlet (outlet) of an internal flow channel 10SZ formed in each channel layer 101Z.

By such a structure, when the fluid A1, A2 having a temperature represented by 50° C. to 80° C. higher than the normal temperature is supplied into the fluid flow channel device (rapid heating), the periphery of the opening 10BZ of each of the flow channel layers 101Z is close to the temperature of the fluids A1, A2, and the temperature of the outer peripheral edge of the flow channel layer 101Z is close to the surrounded environmental temperature (normal temperature). Therefore, when the fluid A1, A2 having a temperature higher than the normal temperature are supplied to the flow channel layer 101Z, a large thermal stress is generated in a portion connecting the outer peripheral edge of the flow channel layer 101Z and the opening 10BZ, and a part of the flow channel layer 101Z tends to be broken in the shortest portion Q shown in FIG. 14. As shown in FIG. 14, when an opening 10BZ and a plurality of internal flow channels 10SZ are arranged in the inner portion of the flow channel layer 101Z, a peripheral portion P in which no fluid flows is largely formed in the periphery thereof. Since the peripheral portion P hardly receives heat from the fluid, its temperature change becomes gentle, and thermal stress tends to occur in the same manner as described above. Such a phenomenon is likely to occur in the corner X of the ceramic core 10Z as shown in FIG. 15. The above phenomenon may similarly occur when the fluids A1 and A2 set at normal temperature are warmed by the high temperature fluid B in the ceramic core 10Z. In addition, if a fluid having a lower temperature than normal temperature represented by −120° C. flows into the plurality of internal flow channels 10SZ (rapid cooling), the above phenomenon may similarly occur.

On the other hand, in the present embodiment, as described above, the ceramic core 10 includes a plurality of internal flow channels 10S (process flow paths 10SA and temperature adjustment flow paths 10SB), and the non-ceramic core holding portion 20 has a function of branching and supplying the fluid to the plurality of internal flow channels 10S and a function of merging and recovering the fluid from the plurality of internal flow channels 10S. The inlets 10S1 and outlets 10S2 of each internal flow channel 10S of the ceramic core 10 are exposed so as to be adjacent to each other on the outer surface 10J of the ceramic core 10. On the other hand, a fluid supply path and a fluid recovery path are formed in the non-ceramic core holding portion 20 (front holding portion 21, rear holding portion 22, left holding portion 23 and right holding portion 24), and the supply port and the recovery port are formed so as to be exposed to the inside surface 20J of the core holding portion 20. When the inner surface 20J of the core holding portion 20 is disposed in close contact with the outer surface 10J of the ceramic core 10, the fluid flowing through the fluid supply path flows into the inlet 10S1 of the plurality of internal flow channels 10S through the supply port. The fluid flowing in the plurality of internal flow channels 10S flows into the fluid recovery path through the recovery port from each outlet 10S2. Therefore, it is possible to prevent the temperature of a part of the ceramic core 10 from largely changing to the temperature around the ceramic core 10 due to the influence of the temperature of the fluid in comparison with the case where a supply port for allowing the fluid to flow into the plurality of inlets 10S1 and a recovery port for receiving the fluid from the plurality of outlets 10S2 are formed inside the ceramic core 10. As a result, the breakage of a part of the brittle ceramic core 10 by a large thermal stress applied to the part is suppressed. On the other hand, since the core holding portion 20 having the supply port and the recovery port is made of non-ceramics, the core holding portion 20 can be thermally deformed even under the influence of the temperature of the fluid, and a part of the core holding portion 20 is prevented from being damaged in comparison with the case where the core holding portion 20 is made of ceramics. As a result, fluid can be stably flowed into a plurality of internal flow channels 10S in the ceramic core 10, and a predetermined treatment can be applied to the fluid. It should be noted that the above-described effect is not only when a fluid having a temperature higher than normal temperature flows into the ceramic core 10 but also when a fluid whose temperature is lower than normal temperature flows into.

In the present embodiment, the ceramic core 10 including the plurality of internal flow channels 10S is arranged so as to be surrounded by the four sub-body members (the front holding portion 21, the rear holding portion 22, the left holding portion 23 and the right holding portion 24). The connecting portion 100 connects the four sub-body members to each other, thereby the four sub-body members can hold the core holding portion 20. As a result, compared to the case where the connecting portion 100 connects the core holding portion 20 and each sub-body member to each other, a strong external force applied to the ceramic core 10 and the need of process for connecting to the ceramic core 10 are reduced. As a result, breakage of the ceramic core 10 is further suppressed. Since the sub-body member of the core holding portion 20 is made of non-ceramic, the sub-body member is hardly broken even if external force is applied from the connecting portion 100 compared with the case where the sub-body member is made of ceramics. Further, compared with the case where the core holding portion 20 is an integral member, the thermal stress of each sub-body member is easily released, and an external force applied to the ceramic core 10 can be reduced. As a result, fluid can be further stably flowed into a plurality of internal flow channels 10S in the ceramic core 10, and a predetermined treatment can be applied to the fluid.

In the present embodiment, the four sub-body members, the upper connecting plate 25, and the lower connecting plate 26 are arranged so as to house the ceramic core 10 including the plurality of internal flow channels 10S (FIG. 1). By the connecting portion 100 connecting the four sub-body members, the upper connecting plate 25 and the lower connecting plate 26 to each other, the four sub-body members, the upper connecting plate 25 and the lower connecting plate 26 can stably hold the ceramic core 10. Since the upper connecting plate 25 and the lower connecting plate 26 are made of non-ceramics, the upper connecting plate 25 and the lower connecting plate 26 are hardly broken even if external force is applied from the connecting portion 100 compared with the case where the upper connecting plate 25 and the lower connecting plate 26 are made of ceramics. As a result, fluid can be further stably flowed into a plurality of internal flow channels 10S in the ceramic core 10, and a predetermined treatment can be applied to the fluid.

Further, in the present embodiment, since the plurality of internal flow channels 10S in the ceramic core 10 is linearly formed between the outer surfaces 10J facing the opposite side each other, it is possible to suppress the occurrence of partial temperature unevenness in the ceramic core 10 by receiving the temperature of the fluid as compared with the case where the plurality of internal flow channels 10S are bent when viewed from the vertical direction. As a result, a large thermal stress generated in a part of the brittle ceramic core 10 is suppressed, and the breakage of the part is further suppressed.

In the present embodiment, the plurality of linear internal flow channels 10S as described above is arranged so as to connect the outer surfaces 10J of the ceramic core 10 to each other. As compared with the case where the plurality of internal flow channels 10S is cut in the middle as viewed from the vertical direction, the region in which fluid does not flow can decrease in the ceramic core 10. In other words, the flow path space ratio of the ceramic core 10 can be increased. As a result, it is possible to suppress the generation of a large thermal stress in the ceramic core 10 by reducing a region which is less susceptible to heat from the fluid.

In this embodiment, since the ceramic core 10 has a plurality of flow path layer structures (laminated structures), the plurality of internal flow channels 10S can be arranged on a plurality of flow channel surfaces R arranged at intervals in the vertical direction. As a result, the plurality of internal flow channels 10S is three-dimensionally arranged in the ceramic core 10, and the processing of the fluid can be efficiently performed.

In this embodiment, since the plurality of process flow paths 10SA are spirally formed, the flow path length of the process flow path 10SA can be set longer as compared with the case where the process flow path 10SA is formed only on the one flow channel surface R.

In this embodiment, since the plurality of process flow paths 10SA and the plurality of temperature adjustment flow paths 10SB are crossed when viewed from the vertical direction, the fluid flowing through the plurality of process flow paths 10SA can perform heat exchange in order between the fluid flowing through the plurality of temperature adjustment flow paths 10SB, and heat exchange efficiency between both flow paths can be enhanced.

A fluid flow channel device 1 according to one embodiment of the present invention has been described. According to the fluid flow channel device 1, the supply port and the recovery port for delivering the fluid between the plurality of internal flow channels 10S are arranged in the non-ceramic core holding portion 20, so that large thermal stress is prevented from being applied to the ceramic core 10. The present invention is not limited to these forms, and the following modified embodiments are possible.

(1) In the above embodiment, although the specific direction is described as the vertical direction, the posture of the fluid flow channel device 1 is not limited to FIG. 1. The fluid flow channel device 1 may be arranged such that the specific direction is a horizontal direction.

(2) In the above embodiment, although the connecting portion 100 has been described in a manner having an upper connecting plate 25 and a lower connecting plate 26, the present invention is not limited thereto. The connecting portion 100 may connect the front holding portion 21 and the rear holding portion 22 by long bolts V to each other and may connect the left holding portion 23 and the right holding portion 24 by long bolts V to each other without having an upper connecting plate 25 and a lower connecting plate 26.

Figure 8:
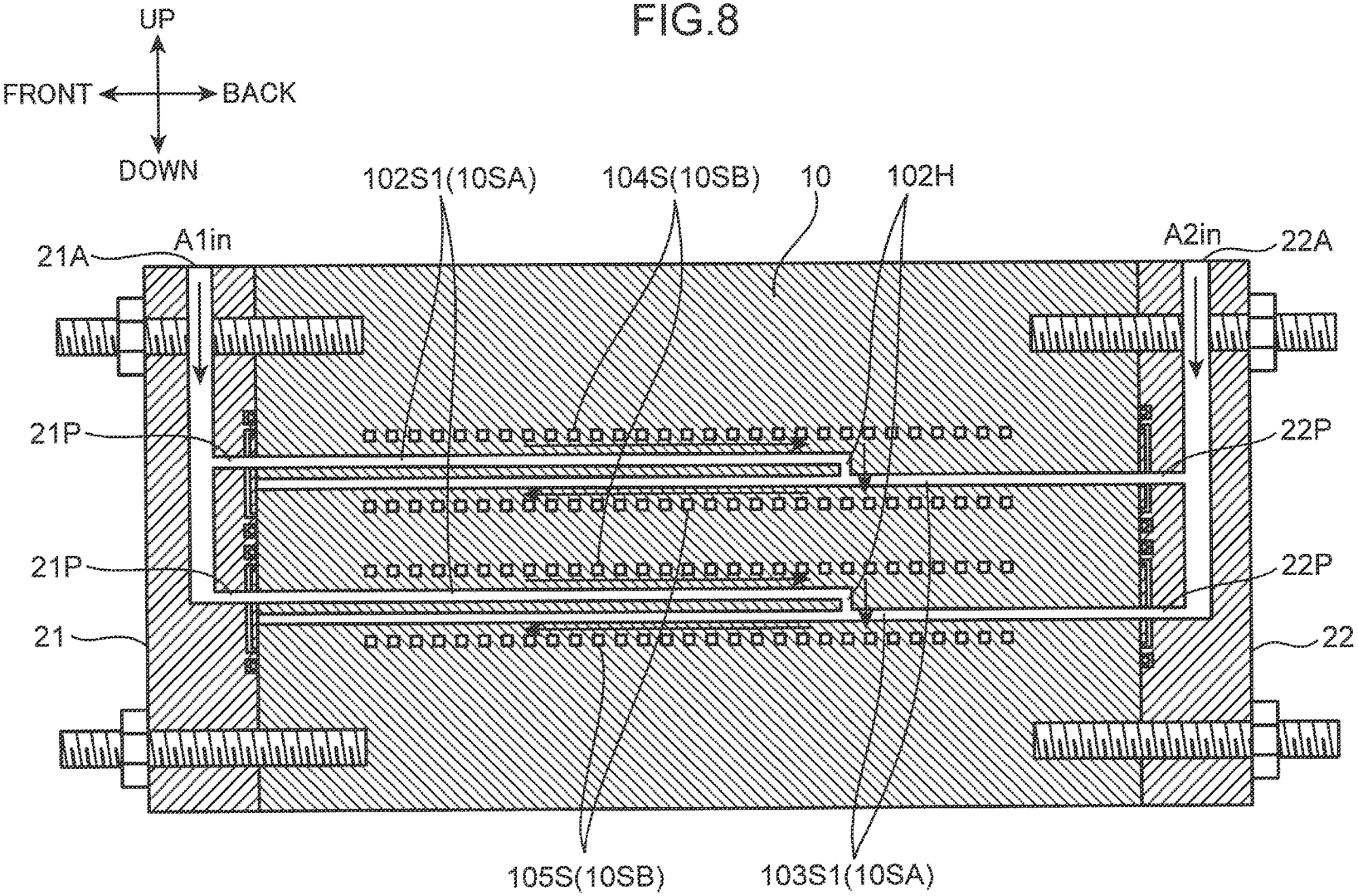
FIG. 8 is a schematic side cross-sectional view for explaining a flow of fluid in a fluid flow channel device according to a first modified embodiment of the present invention.

(3) FIG. 8 is a schematic side sectional view for explaining the flow of fluid in the fluid flow channel device according to the first modified embodiment of the present invention. As shown in FIG. 8, the bolts V and the nuts T as the connecting portion may connect the front holding portion 21 and the rear holding portion 22 with the ceramic core 10 without interposing the upper connecting plate 25 and the lower connecting plate 26. In this case, as shown in FIG. 8, the vertical dimension of the ceramic core 10 is set substantially same as the vertical dimension of the front holding portion 21 and the rear holding portion 22. In FIG. 8, a plurality of layers of spiral flow path structures (process flow paths 10SA) is formed in the integrated ceramic core 10, and each process flow path 10SA is arranged so as to be sandwiched by the flow path 104S and the flow path 105S (temperature adjustment flow path 10SB). In order to save as much as possible the processing of the bolt holes to the brittle ceramic core 10, it is desirable that the upper connecting plate 25 and the lower connecting plate 26 are arranged as in the previous embodiment.

Figure 9:
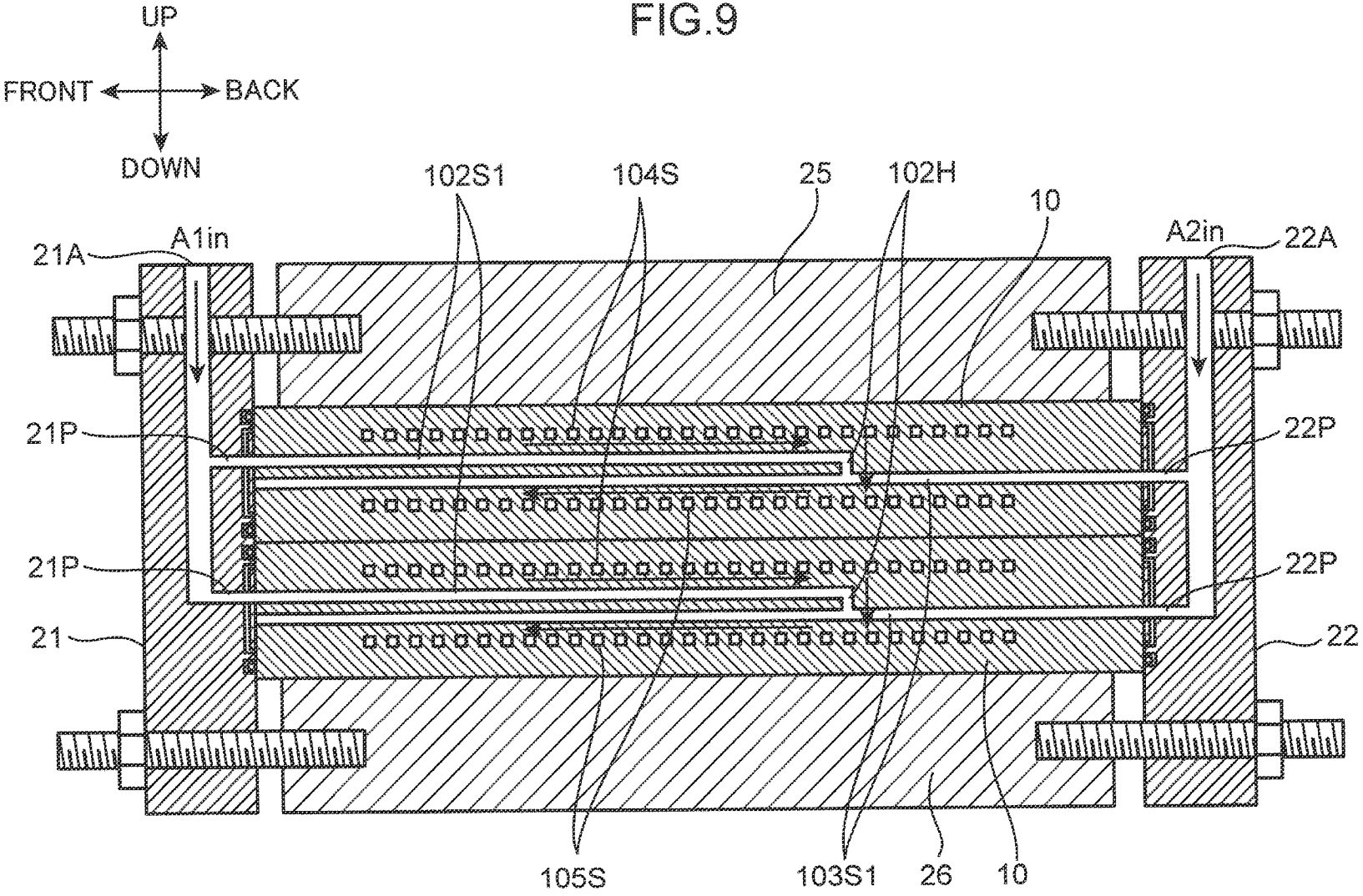
FIG. 9 is a schematic side cross-sectional view for explaining a flow of fluid in a fluid flow channel device according to a second modification embodiment of the present invention.

FIG. 9 is a schematic side sectional view for explaining the flow of the fluid in the fluid flow channel device according to the second modified embodiment of the present invention. As shown in FIG. 9, a plurality of ceramic cores 10 may be stacked in a vertical direction (specific direction). In FIG. 9, an upper connecting plate 25 and a lower connecting plate 26 are arranged above and below the two ceramic cores 10.

Figure 10:
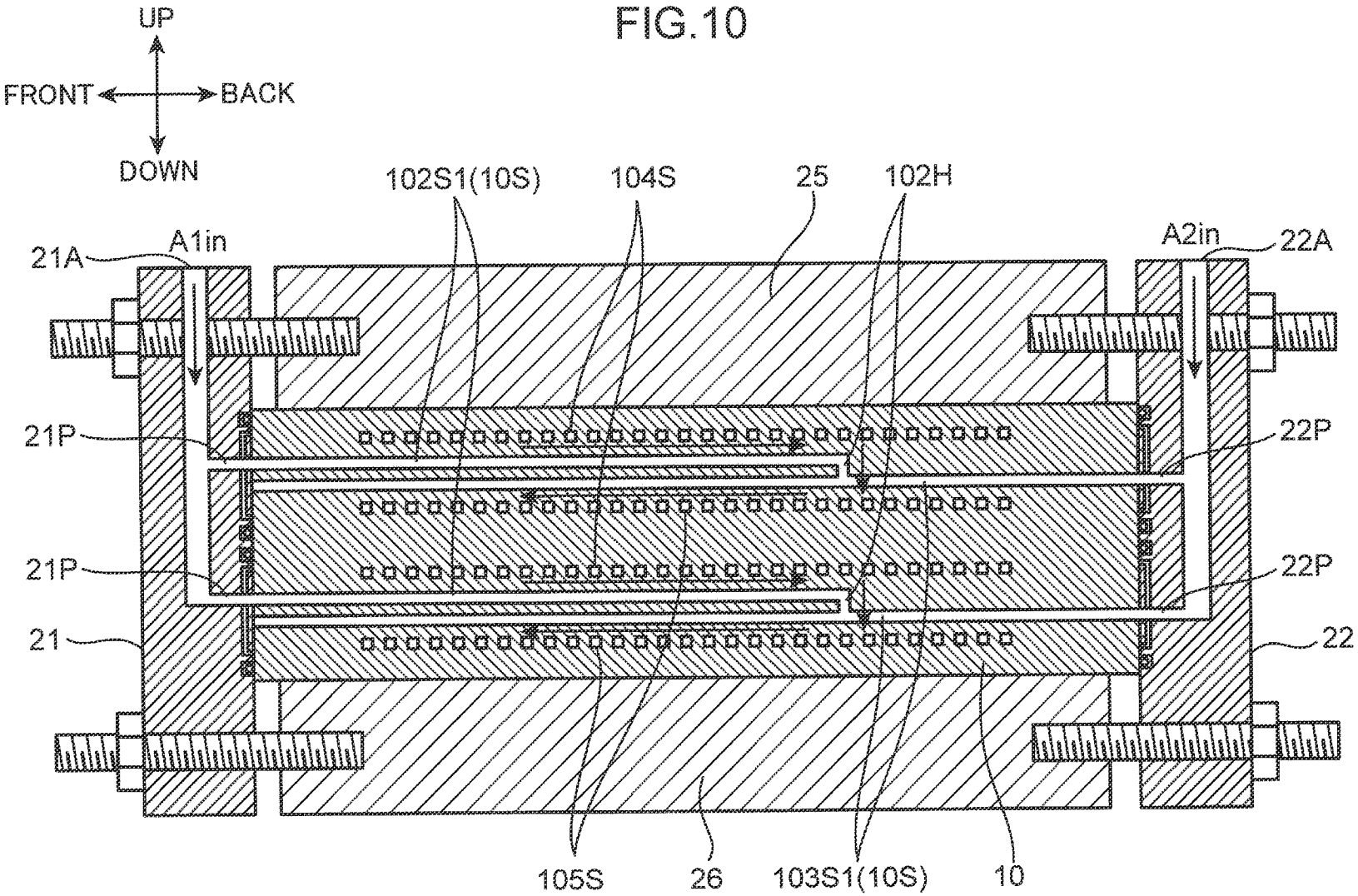
FIG. 10 is a schematic side cross-sectional view for explaining a flow of fluid in a fluid flow channel device according to a third modification embodiment of the present invention.

FIG. 10 is a schematic side sectional view for explaining the flow of fluid in the fluid flow channel device according to the third modified embodiment of the present invention. As shown in FIG. 10, a plurality of internal flow channels 10S may be laminated in the vertical direction (specific direction) in one ceramic core 10. In FIG. 10, an upper connecting plate 25 and a lower connecting plate 26 are arranged above and below one ceramic core 10.

Figure 11:
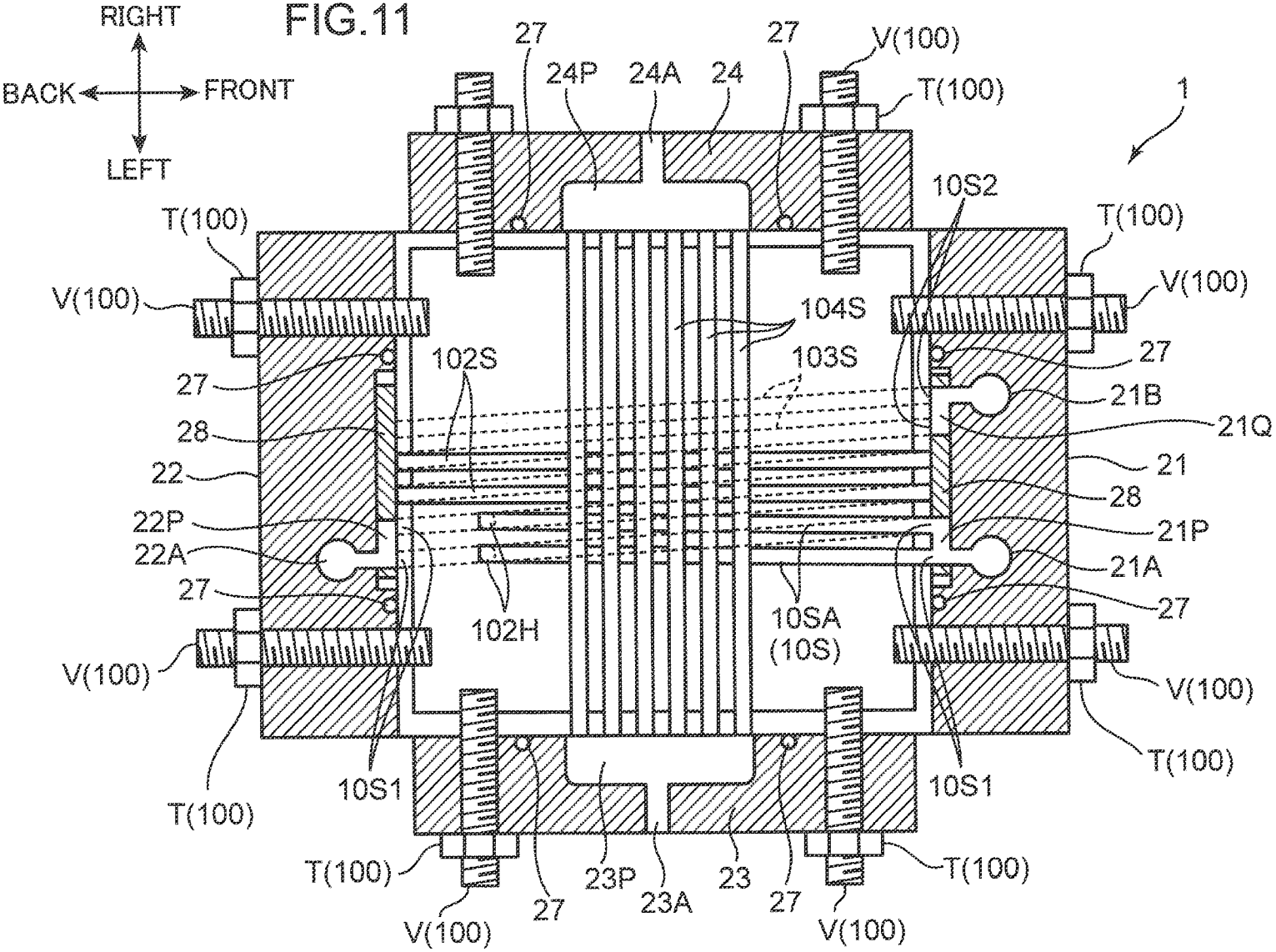
FIG. 11 is a horizontal cross-sectional view of a fluid flow channel device according to a fourth modification embodiment of the present invention.

FIG. 11 is a horizontal cross-sectional view of the fluid flow channel device according to the fourth modified embodiment of the present invention. As shown in FIG. 11, two internal channels 10S may be arranged in a spiral (double spiral structure, multiple spiral structure) in the ceramic core 10. In this case, the openings formed in the gasket 28 may be largely opened to cover two adjacent inlets 10S1 or outlets 10S2. As a result, fluid flows between the supply port 21P, the supply port 22P and the recovery port 21Q, and a plurality of inlets 10S1 adjacent to each other or a plurality of outlets 10S2 adjacent to each other.

Figure 12:
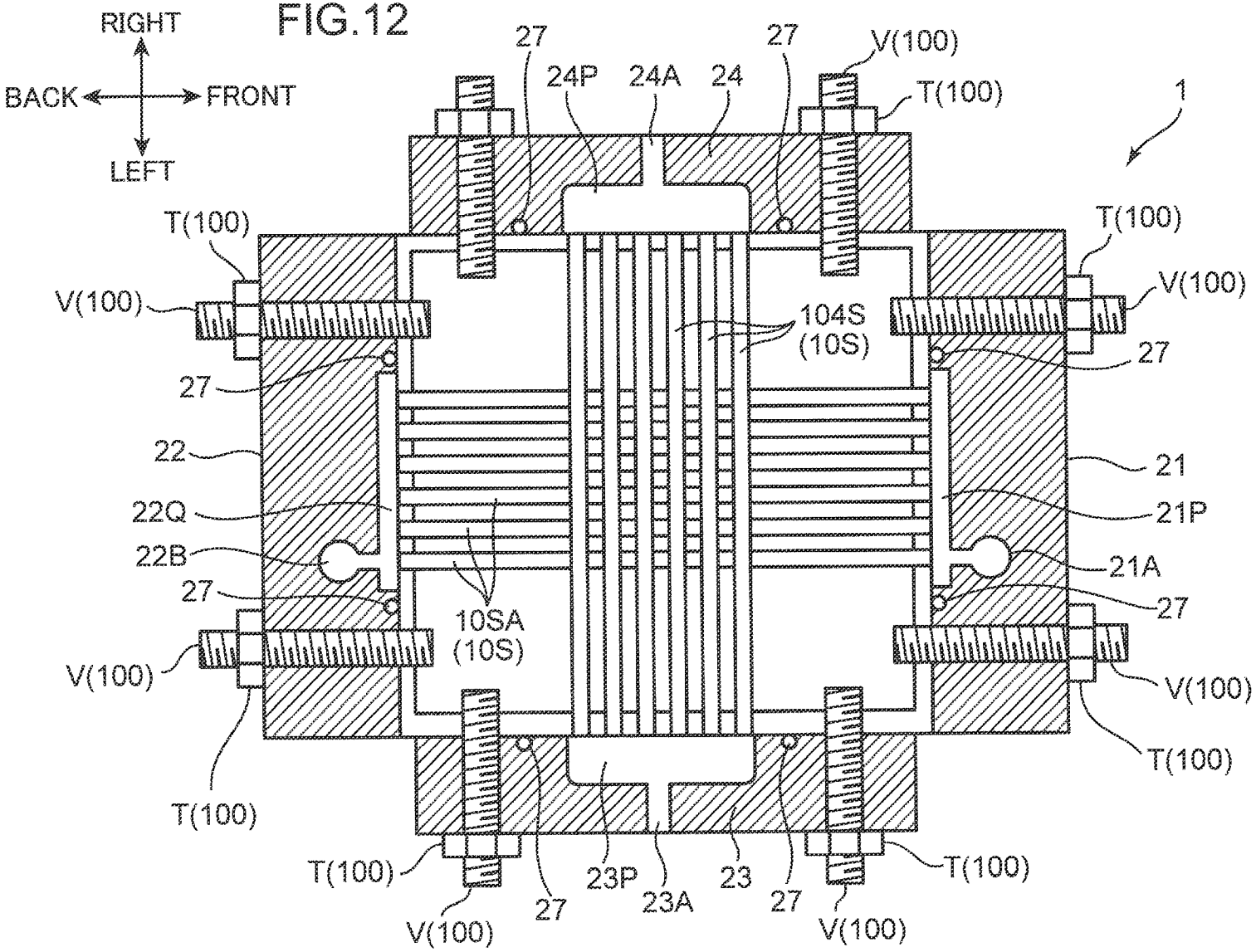
FIG. 12 is a horizontal cross-sectional view of a fluid flow channel device according to a fifth modification embodiment of the present invention.

FIG. 12 is a horizontal cross-sectional view of the fluid flow channel device according to the fifth modified embodiment of the present invention. If a long flow path length is not required for the reaction of the fluid, as shown in FIG. 12, the internal flow channel 10S (process flow path 10A, flow path 104S) formed in the ceramic core 10 may be linearly arranged so as to have an inlet and an outlet that are independent from each other. In this case, the fluid supplied from the fluid supply path 21A flows into each process flow path 10SA collectively through the supply port 21P without providing the gasket 28 as in the previous embodiment, and the fluid is collected from each process flow path 10SA to the fluid recovery path 22B collectively through the recovery port 22Q.

Figure 13:
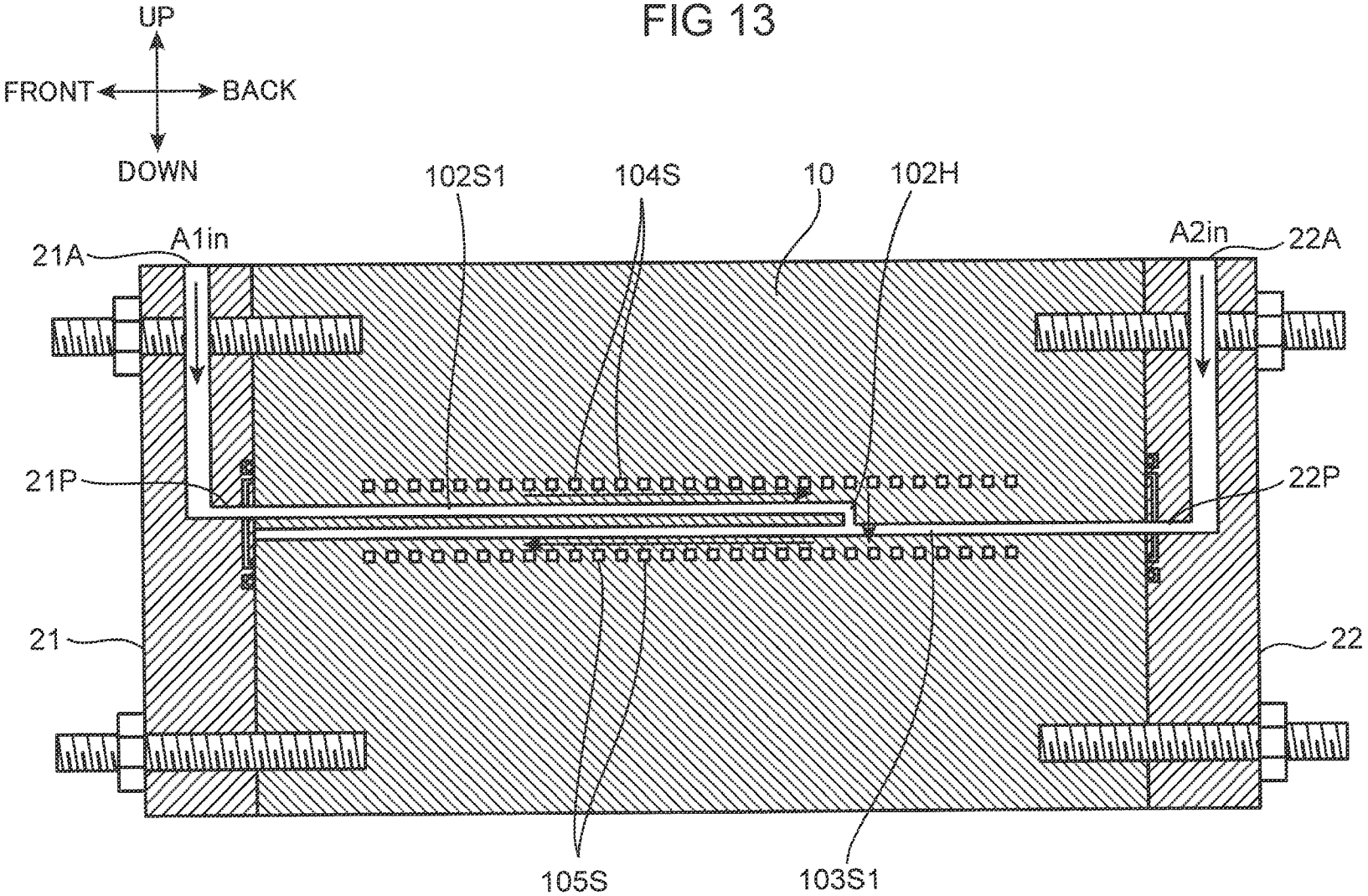
FIG. 13 is a schematic side cross-sectional view for explaining a flow of fluid in a fluid flow channel device according to a sixth modified embodiment of the present invention.

FIG. 13 is a schematic side sectional view for explaining the flow of the fluid in the fluid flow channel device according to the sixth modified embodiment. In FIG. 8, two spiral structures are arranged in the ceramic core 10, but one spiral structure may be arranged in the ceramic core 10 as shown in FIG. 13. That is, the spiral process flow path 10SA formed in the first process layer 102 and the second process layer 103 (FIG. 5) in the ceramic core 10 may be one or more.

(4) The number of the sub-body members constituting the core holding portion 20 is not limited to four. The core holding portion 20 may have two sub-body members such as the front holding portion 21 and the rear holding portion 22, or the other number of sub-body members may be disposed.

(5) The flow path (flow path 104S, 105S) for temperature adjustment as shown in FIG. 5 may be omitted.

In accordance with the present invention, there is provided a fluid flow channel device comprising a ceramic main body and a non-ceramic sub-body. The main body includes a plurality of internal flow channels each including an inlet and an outlet independent of each other and allowing fluid to flow along at least one flow channel surface, and at least one outer surface orthogonal to the at least one flow channel surface, wherein the inlets of the plurality of internal flow channels are disposed so as to be adjacent to each other and exposed to the at least one outer surface, the outlets of the plurality of internal flow channels are disposed so as to be adjacent to each other and exposed to the at least one outer surface. The sub-body includes at least one inner surface and at least one fluid supply passage allowing fluid to flow therethrough and having a supply port exposed to the at least one inner surface and supplying fluid to the plurality of internal flow channels in a lump, and at least one fluid recovery passage allowing fluid to flow therethrough and including a recovery port exposed to the at least one inner surface and receiving fluid from the plurality of internal flow passages in a lump wherein the at least one inner surface is disposed in close contact with the at least one outer surface of the main body such that the supply port is disposed opposite the plurality of inlets so as to cover the inlets of the plurality of internal flow channels and the recovery port is disposed opposite the plurality of outlets so as to cover the outlets of the plurality of internal flow channels.

According to the present configuration, the ceramic main body includes a plurality of internal flow channels, and the non-ceramic sub-body has a function of branching and supplying the fluid to the plurality of internal flow channels and a function of merging and recovering the fluid from the plurality of internal flow channels. The inlet and outlet of each internal flow channel of the main body are exposed to be adjacent to each other on the outer side surface of the main body. On the other hand, a fluid supply path and a fluid recovery path are formed in the non-ceramic sub-body, and the supply port and the recovery port are formed so as to be exposed to the inner surface of the sub-body. In a state in which the inner surface of the sub-body is disposed in close contact with the outer surface of the main body, the fluid supplied from the fluid supply path flows into the inlet of the plurality of internal flow channels through the supply port. Further, the fluid flowing through the plurality of internal channels flows from each outlet to the fluid recovery path through the recovery port. For this reason, compared with the case where a supply port for allowing the fluid to flow into the plurality of inlets and a recovery port for receiving the fluid from the plurality of outlets are formed inside the ceramic main body, the temperature of a part of the main body is prevented from largely varying with respect to the temperature around the main body affected by the temperature of the fluid. As a result, a large thermal stress applied to a part of the brittle ceramic main body is suppressed, and the breakage of the part is suppressed. On the other hand, since the sub-body having the supply port and the recovery port is made of non-ceramic, it is possible to perform thermal deformation even under the influence of the temperature of the fluid, and the breakage of a part of the sub-body is suppressed as compared with the case where the sub-body is made of ceramics. As a result, fluid can be stably flowed into a plurality of internal flow channels in the main body, and a predetermined treatment can be applied to the fluid.

In the above configuration, it is preferable that the main body has a rectangular parallelepiped shape, and the at least one outer surface includes a first outer surface, a second outer surface, a third outer surface and a fourth outer surface that are orthogonal to the at least one flow channel surface and define the rectangular parallelepiped shape, the sub-body includes a first sub-body member, a second sub-body member, a third sub-body member and a fourth sub-body member disposed so as to sandwich the main body from four sides along a surface parallel to the at least one flow channel surface, each of the inner side surfaces of the first sub-body member, the second sub-body member, the third sub-body member and the fourth sub-body member being disposed in close contact with the first outer surface, the second outer surface, the third outer surface and the fourth outer surface of the main body, respectively, and the fluid flow channel device further comprising a connecting portion for connecting the first sub-body member, the second sub-body member, the third sub-body member and the fourth sub-body member along a direction parallel to the at least one flow channel surface so that the first sub-body member, the second sub-body member, the third sub-body member and the fourth sub-body member hold the main body.

According to this configuration, the main body including the plurality of internal flow channels is arranged so as to be surrounded by the four sub-body members. The connecting portion connects the four sub-body members to each other, thereby the four sub-body members can hold the main body. As a result, the main body and the sub-body that are made of different materials each other can be brought into close contact with each other, and the fluid can be delivered between the main body and the sub-body. Further, compared with the case where the sub-body is an integral member, the thermal stress of the sub-body member is easily released, and the external force applied to the main body can be reduced.

In the above configuration, it is preferable that the main body further includes a pair of sub outer surfaces connecting one end and the other end, in a specific direction orthogonal to the at least one flow channel surface, of the first outer surface, the second outer surface, the third outer surface and the fourth outer surface to each other, the first sub-body member, the second sub-body member, the third sub-body member and the fourth sub-body member respectively have a larger dimension than the main body in the specific direction so as to protrude to one end side and the other end side in the specific direction from the main body, the connecting portion includes: a pair of non-ceramic connection body members having a first opposing surface disposed opposite to the sub outer surface, and at least four second opposing surfaces disposed opposite to the first sub-body member, the second sub-body member, the third sub-body member and the fourth sub-body member respectively, and the pair of non-ceramic connection body members being disposed so as to sandwich the main body from both sides in the specific direction; and a plurality of connection member connecting one end and the other end, in the specific direction, of the first sub-body member, the second sub-body member, the third sub-body member and the fourth sub-body member and the pair of connection body members to each other along a direction parallel to the at least one flow channel surface so that the first sub-body member, the second sub-body member, the third sub-body member, the fourth sub-body member and the pair of the connection body members house the main body.

According to this configuration, the connecting portion connects the four sub-body members and the pair of connection body members to each other, thereby the four sub-body members and the pair of connection body members can stably house and hold the main body. Since the connecting body members are made of non-ceramic, the connecting body members are less likely to be damaged even when receiving an external force in comparison with the case where the connecting body members are made of ceramics. As a result, fluid can be further stably flowed into a plurality of internal flow channels in the main body, and a predetermined treatment can be applied to the fluid.

In the above configuration, it is preferable that when the main body is viewed from a specific direction that is a direction orthogonal to the at least one flow channel surface between one outer surface and the other outer surface, disposed on the side opposite to the one outer surface in a direction orthogonal to the one outer surface, out of the first outer surface, the second outer surface, the third outer surface and the fourth outer surface, the plurality of internal flow channels respectively extends linearly so as to connect the one outer surface and the other outer surface to each other.

According to this configuration, since the plurality of internal flow channels is linearly formed, it is possible to suppress the occurrence of partial temperature unevenness in the main body by receiving the temperature of the fluid as compared with the case where the internal flow channel is bent when viewed from the specific direction. As a result, a large thermal stress generated in a part of the brittle ceramic main body is suppressed, and the breakage of the part is further suppressed.

In the above configuration, it is preferable that the at least one flow channel surface includes a first flow channel surface and a second flow channel surface disposed at an interval from the first flow channel surface in the specific direction, each of the plurality of internal flow channels includes: a plurality of first internal flow channels extending linearly so as to connect the one outer surface and the other outer surface to each other and allowing fluid to flow along the first flow channel surface, and a plurality of second internal flow channels extending linearly so as to connect the one outer surface and the other outer surface to each other and allowing fluid to flow along the second flow channel surface.

According to this configuration, the plurality of internal flow channels can be disposed on a plurality of flow channel surfaces arranged at intervals in a specific direction. As a result, the plurality of internal channels is three-dimensionally arranged in the main body, and the processing of the fluid can be efficiently performed.

In the above configuration, it is preferable that each of the plurality of internal flow channels includes: a plurality of first connection flow paths connecting an end portion on the one outer surface side of the plurality of first internal flow channels and an end portion on the one outer surface side of the plurality of second internal flow channels along the specific direction, and a plurality of second connection flow paths connecting an end portion on the other outer surface side of the plurality of first internal flow channels and an end portion on the other outer surface side of the plurality of second internal flow channels along the specific direction, the plurality of first internal flow channels, the plurality of second internal flow channels, the plurality of first connection paths and the plurality of second connection paths are spirally connected so as to allow the fluid flowing through the internal flow channel to move in a direction parallel to the first flow channel surface and intersecting with the plurality of first internal flow channels.

According to this configuration, since the plurality of internal flow channels is formed in spiral shape, the flow path length of the internal flow channel can be set long as compared with the case where the internal flow channel is formed by being limited to the one flow channel surface.

In the above configuration, it is preferable that the plurality of internal flow channels further includes a plurality of temperature adjustment flow paths that are disposed opposite to at least one plurality of internal flow channels out of the plurality of first internal flow channels and the plurality of second internal flow channels in the specific direction, and the plurality of temperature adjustment flow paths allowing fluid for heat exchange with the fluid flowing through the at least one plurality of internal flow channels to flow, and the plurality of temperature adjustment flow paths is disposed so as to intersect with the at least one plurality of internal flow channels when viewing the main body from the specific direction.

According to this configuration, since the plurality of first internal flow channels or the plurality of second internal flow channels and the plurality of temperature adjustment flow paths cross each other when viewed from a specific direction, heat exchange can be performed in order between the fluid flowing through the plurality of internal flow channels and the fluid flowing through the plurality of temperature adjustment paths, and heat exchange efficiency between both flow paths can be enhanced.

According to the present invention, there is provided a fluid flow channel device comprising a ceramic body having a plurality of internal flow channels, wherein a part of the body is prevented from being damaged by the influence of the temperature of the fluid.

The invention claimed is:

1. A fluid flow channel device comprising:

a ceramic main body including a plurality of internal flow channels having an inlet and an outlet that are independent of each other and allowing fluid to flow along at least one flow channel surface, and at least one outer surface orthogonal to the at least one flow channel surface, the inlets of the plurality of internal flow channels are disposed so as to be adjacent to each other and exposed to the at least one outer surface, and the outlets of the plurality of internal flow channels are disposed so as to be adjacent to each other and exposed to the at least one outer surface, a non-ceramic sub-body including at least one inner surface and at least one fluid supply path allowing fluid to flow therethrough and having a supply port exposed to the at least one inner surface and supplying fluid to the plurality of internal flow channels correctively, and at least one fluid recovery path allowing fluid to flow therethrough and including a recovery port exposed to the at least one inner surface and receiving fluid from the plurality of internal flow channels collectively, the at least one inner surface being disposed in close contact with the at least one outer surface of the main body such that the supply port is disposed opposite to the plurality of inlets of the plurality of internal flow channels so as to cover the inlets and the recovery port is disposed opposite to the plurality of outlets of the plurality of internal flow channels so as to cover the outlets.

2. The fluid flow channel device according to claim 1, wherein the main body has a rectangular parallelepiped shape, and the at least one outer surface includes a first outer surface, a second outer surface, a third outer surface and a fourth outer surface that are orthogonal to the at least one flow channel surface and define the rectangular parallelepiped shape, the sub-body includes a first sub-body member, a second sub-body member, a third sub-body member and a fourth sub-body member disposed so as to sandwich the main body from four sides along a surface parallel to the at least one flow channel surface, each of the inner side surfaces of the first sub-body member, the second sub-body member, the third sub-body member and the fourth sub-body member being disposed in close contact with the first outer surface, the second outer surface, the third outer surface and the fourth outer surface of the main body, respectively, and the fluid flow channel device further comprising a connecting portion for connecting the first sub-body member, the second sub-body member, the third sub-body member and the fourth sub-body member along a direction parallel to the at least one flow channel surface so that the first sub-body member, the second sub-body member, the third sub-body member and the fourth sub-body member hold the main body.

3. The fluid flow channel device according to claim 2, wherein the main body further includes a pair of sub outer surfaces connecting one end and the other end, in a specific direction orthogonal to the at least one flow channel surface, of the first outer surface, the second outer surface, the third outer surface and the fourth outer surface to each other, the first sub-body member, the second sub-body member, the third sub-body member and the fourth sub-body member respectively have a larger dimension than the main body in the specific direction so as to protrude to one end side and the other end side in the specific direction from the main body, the connecting portion includes:

a pair of non-ceramic connection body members having a first opposing surface disposed opposite to the sub outer surface, and at least four second opposing surfaces disposed opposite to the first sub-body member, the second sub-body member, the third sub-body member and the fourth sub-body member respectively, and the pair of non-ceramic connection body members being disposed so as to sandwich the main body from both sides in the specific direction; and a plurality of connection member connecting one end and the other end, in the specific direction, of the first sub-body member, the second sub-body member, the third sub-body member and the fourth sub-body member and the pair of connection body members to each other along a direction parallel to the at least one flow channel surface so that the first sub-body member, the second sub-body member, the third sub-body member, the fourth sub-body member and the pair of the connection body members house the main body.

4. The fluid flow channel device according to claim 2, wherein when the main body is viewed from a specific direction that is a direction orthogonal to the at least one flow channel surface between one outer surface and the other outer surface, disposed on the side opposite to the one outer surface in a direction orthogonal to the one outer surface, out of the first outer surface, the second outer surface, the third outer surface and the fourth outer surface, the plurality of internal flow channels respectively extends linearly so as to connect the one outer surface and the other outer surface to each other.

5. The fluid flow channel device according to claim 4, wherein the at least one flow channel surface includes a first flow channel surface and a second flow channel surface disposed at an interval from the first flow channel surface in the specific direction, each of the plurality of internal flow channels includes:

a plurality of first internal flow channels extending linearly so as to connect the one outer surface and the other outer surface to each other and allowing fluid to flow along the first flow channel surface, and a plurality of second internal flow channels extending linearly so as to connect the one outer surface and the other outer surface to each other and allowing fluid to flow along the second flow channel surface.

6. The fluid flow channel device according to claim 5, wherein each of the plurality of internal flow channels includes:

a plurality of first connection flow paths connecting an end portion on the one outer surface side of the plurality of first internal flow channels and an end portion on the one outer surface side of the plurality of second internal flow channels along the specific direction, and a plurality of second connection flow paths connecting an end portion on the other outer surface side of the plurality of first internal flow channels and an end portion on the other outer surface side of the plurality of second internal flow channels along the specific direction, the plurality of first internal flow channels, the plurality of second internal flow channels, the plurality of first connection paths and the plurality of second connection paths are spirally connected so as to allow the fluid flowing through the internal flow channel to move in a direction parallel to the first flow channel surface and intersecting with the plurality of first internal flow channels.

7. The fluid flow channel device according to claim 5, wherein the plurality of internal flow channels further includes a plurality of temperature adjustment flow paths that are disposed opposite to at least one plurality of internal flow channels out of the plurality of first internal flow channels and the plurality of second internal flow channels in the specific direction, and the plurality of temperature adjustment flow paths allowing fluid for heat exchange with the fluid flowing through the at least one plurality of internal flow channels to flow, and the plurality of temperature adjustment flow paths is disposed so as to intersect with the at least one plurality of internal flow channels when viewing the main body from the specific direction.

* * * * *